US010472933B2

(12) United States Patent
Steele

(10) Patent No.: US 10,472,933 B2
(45) Date of Patent: Nov. 12, 2019

(54) MULTILATERAL JUNCTION FITTING FOR INTELLIGENT COMPLETION OF WELL

(71) Applicant: HALLIBURTON ENERGY SERVICES INC, Houston, TX (US)

(72) Inventor: David J. Steele, Arlington, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/890,574

(22) PCT Filed: Jul. 10, 2014

(86) PCT No.: PCT/US2014/046226
§ 371 (c)(1),
(2) Date: Nov. 11, 2015

(87) PCT Pub. No.: WO2016/007165
PCT Pub. Date: Jan. 14, 2016

(65) Prior Publication Data

US 2017/0107794 A1 Apr. 20, 2017

(51) Int. Cl.
*E21B 41/00* (2006.01)
*E21B 17/00* (2006.01)
*E21B 34/06* (2006.01)

(52) U.S. Cl.
CPC ..... *E21B 41/0035* (2013.01); *E21B 17/003* (2013.01); *E21B 34/06* (2013.01)

(58) Field of Classification Search
CPC ..... E21B 41/0035; E21B 41/0042; E21B 17/003; E21B 34/06
See application file for complete search history.

(56) References Cited

U.S. PATENT DOCUMENTS 5,918,669 A 7/1999 Morris et al.
6,089,320 A 7/2000 Lagrange
(Continued)

FOREIGN PATENT DOCUMENTS

CN 101280677 A 10/2008
CN 104011326 A 8/2014
(Continued)

OTHER PUBLICATIONS

International Search Report and Written Opinion, dated Mar. 25, 2015, 17 pages; Korean Intellectual Property Office, International Searching Authority.
(Continued)

*Primary Examiner* — Waseem Moorad
*Assistant Examiner* — Neel Girish Patel
(74) *Attorney, Agent, or Firm* — Haynes and Boone, LLP

(57) ABSTRACT

A completion system and method for intelligent control of multilateral wells. A wye-shaped junction fitting defines a hollow interior that is fluidly coupled with the uphole tubing string and both downhole main and lateral completion strings. Hydraulic, electric, and/or fiber-optic communication line segments extend between the uphole end and both downhole ends of the junction fitting for providing power, control or communications between the surface and all production zones. The communication line segments are located outside the junction fitting interior and may be located within longitudinal grooves formed along the exterior wall surface of the junction fitting. Stabable, wet-matable connectors may be provided at each end of the junction fitting, which connect the both interior flow paths and communication lines, and which may allow connection at any relative radial orientation.

24 Claims, 11 Drawing Sheets

(56) References Cited

U.S. PATENT DOCUMENTS 6,158,513 A * 12/2000 Nistor ..... E21B 23/002 166/117.6
6,189,616 B1 2/2001 Gano et al.
6,439,932 B1 * 8/2002 Ripolone ..... E21B 17/028 439/668
6,729,410 B2 5/2004 Steele
6,863,129 B2 3/2005 Ohmer et al.
9,140,102 B2 9/2015 Bartko et al.
9,175,523 B2 11/2015 Patel et al.
9,249,559 B2 2/2016 Dyer et al.
2001/0025710 A1 10/2001 Ohmer et al.
2001/0035288 A1 * 11/2001 Brockman ..... E21B 17/003 166/65.1
2002/0112857 A1 * 8/2002 Ohmer ..... E21B 17/203 166/313
2003/0159827 A1 8/2003 Steele
2003/0221829 A1 * 12/2003 Patel ..... A45C 13/02 166/278
2004/0159444 A1 * 8/2004 Wolters ..... E21B 17/02 166/381
2004/0168809 A1 9/2004 Nobileau
2004/0182579 A1 9/2004 Steele et al.
2005/0121190 A1 6/2005 Oberkircher et al.
2006/0289156 A1 12/2006 Murray
2007/0227727 A1 * 10/2007 Patel ..... E21B 17/028 166/250.01
2009/0008078 A1 * 1/2009 Patel ..... E21B 34/10 166/50
2009/0066535 A1 * 3/2009 Patel ..... E21B 17/028 340/853.2
2009/0229834 A1 * 9/2009 Bolding ..... E21B 33/068 166/375
2011/0036576 A1 2/2011 Schultz et al.
2011/0100645 A1 * 5/2011 Yapici ..... E21B 23/04 166/375
2013/0008645 A1 1/2013 Wetzel et al.
2013/0087321 A1 * 4/2013 Bartko ..... E21B 43/26 166/66
2013/0112901 A1 * 5/2013 Biddick ..... E21B 34/10 251/12
2013/0175047 A1 7/2013 Steele et al.
2013/0192851 A1 8/2013 Algeroy et al.
2013/0327572 A1 12/2013 Sponchia et al.
2014/0083683 A1 * 3/2014 Tips ..... E21B 47/12 166/250.01
2015/0129319 A1 * 5/2015 D'Silva ..... H01R 39/385 175/320
2015/0275587 A1 * 10/2015 Wolf ..... E21B 17/02 166/380
2016/0356095 A1 * 12/2016 Perez ..... E21B 47/123
2017/0145777 A1 5/2017 Vasques et al.

FOREIGN PATENT DOCUMENTS

WO WO 2013/184435 A1 12/2013
WO 2014059098 4/2014
WO WO2014059098 A1 4/2014
WO WO2016007165 A1 1/2016
WO WO 2016/043737 A1 3/2016

OTHER PUBLICATIONS

Examination Report issued in related GCC Patent App. No. GC 2015-29696 dated Jul. 28, 2018 (6 pages).
Search Report and Written Opinion issued in related PCT App. No. PCT/US2014/056112 dated Jun. 16, 2015 (21 pages).
First Office Action and Search Report issued in related Chinese Patent App. No. 2014800808755 dated Apr. 2, 2018 (13 pages).
First Examination Report issued in the related GCC Patent App. No. GC 2015-29792 dated Dec. 6, 2017 (4 pages).
Search Report and Written Opinion issued in related Singapore Patent App. No. 11201700567T dated Jun. 28, 2018 (11 pages).
Extended Search Report issued in related European Patent App. No. 14902077.8 dated Feb. 21, 2018 (7 pages).
Extended Search Report issued for European Patent Application No. 14897380, dated Mar. 21, 2018, 9 pages.
Search Report and Written Opinion issued in related Singapore Patent Application No. 11201609326X dated Mar. 6, 2018.

* cited by examiner

MULTILATERAL JUNCTION FITTING FOR INTELLIGENT COMPLETION OF WELL

CROSS REFERENCE TO RELATED APPLICATIONS

The present application is a U.S. National Stage patent application of International Patent Application No. PCT/US2014/046226, filed on 10 Jul. 2014, the benefit of which is claimed and the disclosure of which is incorporated herein by reference in its entirety.

TECHNICAL FIELD

The present disclosure relates generally to operations performed and equipment utilized in conjunction with a subterranean well such as a well for recovery of oil, gas, or minerals. More particularly, the disclosure relates to intelligent well completion systems and methods.

BACKGROUND

In the quest to improve hydrocarbon recovery and reduce the developmental cost in challenging, multi-stacked compartmentalized fields as well as oil-rim reservoirs (reservoirs wedged between a gas-cap and an aquifer), well type and completion design has been found to play a significant role. Multi-stacked, compartmentalized, and/or oil rim reservoirs may be complex in structure with relatively high levels of reservoir heterogeneity. By their nature, these reservoirs may present many challenges for active reservoir management if they are to be productive and commercially viable.

Several technologies are known for developing such fields. One technique is the use of dual-string or multi-string completions, in which a separate production string is positioned within the well for serving each discrete production zone. That is, multiple strings may be positioned side-by-side within the main, or parent, wellbore. However, cross-sectional area in a wellbore is a limited commodity, and the main wellbore must accommodate equipment and multiple tubing strings having sufficient flow area. Although for shallow wells that only intercept two zones, dual-completions may be commercially viable, such a system may be less than ideal for wells with greater than two zones or for deep or complex wells with long horizontal runs.

Another technique is to use a single production string to serve all of the production zones and to employ selective flow control downhole for each zone. Such systems are commonly referred to as "intelligent well completions" and may include multi-lateral, selective and controlled injection and depletion systems, dynamic active-flow-control valves, and downhole pressure, temperature, and/or composition monitoring systems. Intelligent completions may prevent or delay water or gas breakthrough, increase the productivity index, and also, properly control drawdown to mitigate wellbore instability, sand failure, and conformance issues. Active flow-control valves may allow for fewer wells to be drilled by enabling efficient commingled injection and production wells to be developed. Moreover, with downhole monitoring and surveillance, work-overs can be minimized, further reducing operating costs. Accordingly, intelligent well completions have become a technology of interest for optimizing the productivity and ultimate recovery of hydrocarbons.

BRIEF DESCRIPTION OF THE DRAWINGS

Embodiments are described in detail hereinafter with reference to the accompanying figures, in which.

DETAILED DESCRIPTION

Figure 1:
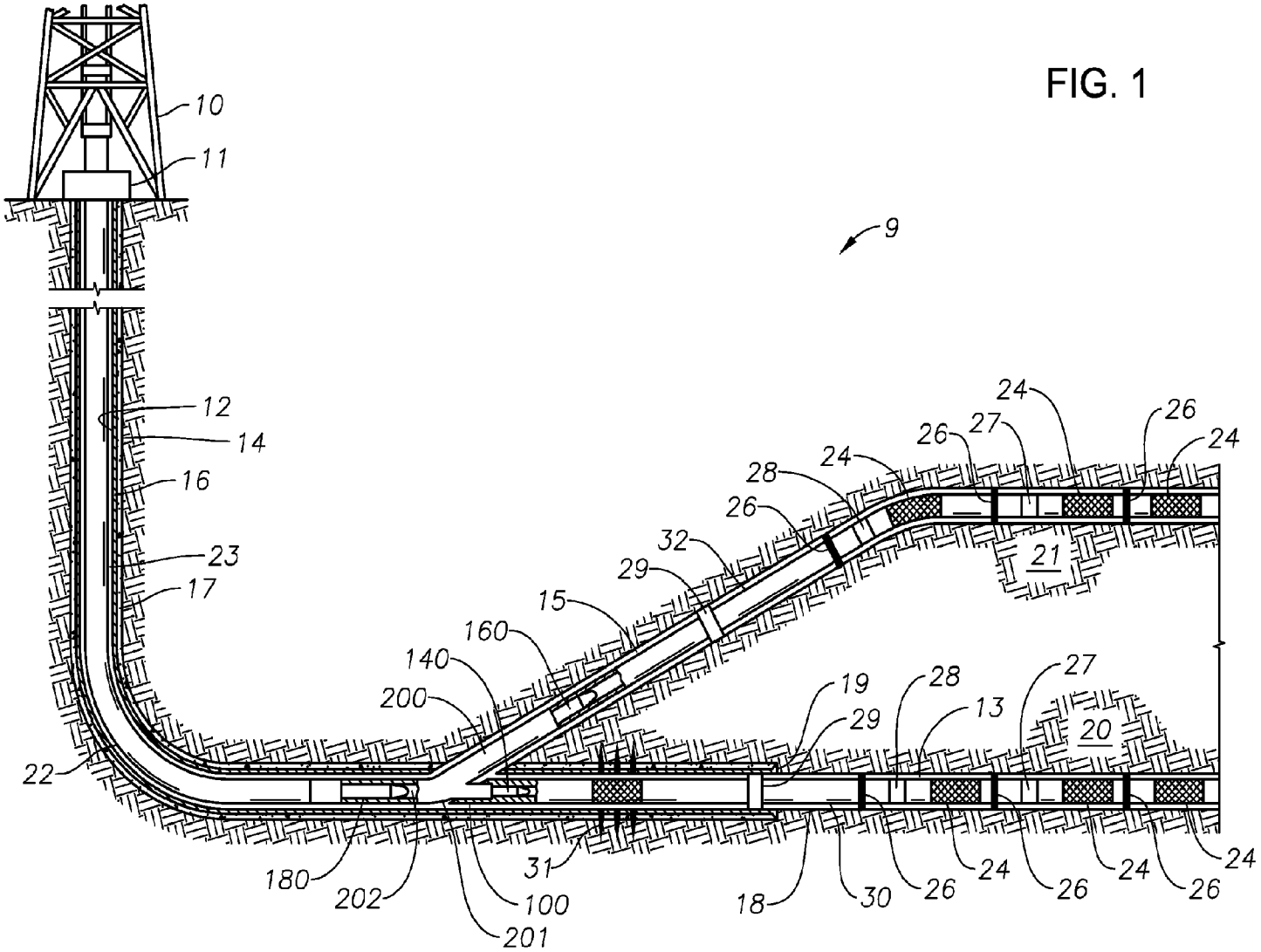
FIG. 1 is an elevation view in partial cross section of a portion of an intelligent multilateral well system according to an embodiment, showing wellbore with a main wellbore, a lateral wellbore, a main completion string having a completion deflector located within a downhole portion of the main wellbore, a lateral completion string located within the lateral wellbore, a junction fitting joining the main and lateral completion strings, and a tubing string connected to the top of the junction fitting.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream,"

and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. In addition, figures are not necessarily drawn to scale but are presented for simplicity of explanation.

Generally, an intelligent well is one with remote zonal control and reservoir monitoring. The simplest form of monitoring may be from the surface (e.g., wellhead pressure and flow rate measurements). More sophisticated monitoring may use downhole gauges, which typically may be run with intelligent well completions for pressure and temperature measurements and acoustic monitoring systems. Downhole flow control valves may be autonomous, controlled downhole, or controlled from the surface. Communication lines passing between the surface and downhole locations for reservoir monitoring and remote zonal control may include electrical, hydraulic, and fiber optic lines, for example.

Regardless of whether a dual-string completion or a single-string intelligent completion is used, the typical process of completing the well at a lateral junction is substantially similar. One or more upper portions of the main wellbore is first drilled and, typically, a casing is installed. After casing installation, a lower portion of the main wellbore may be drilled.

A first portion of a main bore completion string is attached to a work string and run into the main wellbore. This main bore completion string portion may include perforators, screens, flow control valves, downhole permanent gauges, hangers, packers, and the like. The uphole end of the first main bore completion string portion may terminate with a liner hanger, such as a packer or anchor, which is set at or near the lower end of the main bore casing for suspending the main bore completion string.

To initiate a lateral, or branch, wellbore, a deflector tool, for example a whipstock, may be attached to a work string and run into the wellbore and set at a predetermined position. A temporary barrier may also be installed with the whipstock to keep the main wellbore clear of debris generated while drilling the lateral wellbore. The work string may then tripped out of the wellbore, leaving the whipstock in place, and a milling tool may be run into the wellbore. The deflector tool deflects the milling tool into the casing to cut a window through the casing and thereby initiate the lateral wellbore. The milling tool may then be replaced with a drill bit, and the lateral leg of the well drilled. The lateral leg may be cased and cemented, or it may be left open. After the lateral wellbore is drilled, a retrieval tool may be attached to the work string and run into the wellbore to connect to the deflector tool. The retrieval tool, deflector tool and barrier may then be withdrawn.

Next, a second portion of the main bore completion string may be attached to the work string, run into the main wellbore, and connected to the first main bore completion string portion. The second main bore completion string portion may include control lines and "wet connect" plugs to engage into "wet connect" receptacles provided with the first main bore completion string portion. The wet-connect connectors will sealingly engage the wet-connect receptacles to provide surface control, monitoring and/or power for the flow control valves, downhole permanent gauges, and the like. The uphole end of the second main bore completion string portion may terminate with a completion deflector. The main bore completion string may be positioned in the main wellbore so that the completion deflector is at a position at the lateral junction for deflecting a subsequently run lateral bore completion string through the window and into the lateral wellbore. The completion deflector may include a receptacle connector at its uphole end, into which a stinger connector of a junction may ultimately be received.

A lateral bore completion string may then be run into the wellbore. The lateral bore completion string may include perforators, screens, flow control valves, downhole permanent gauges, hangers, packers, and the like. The lateral bore completion string may also include a junction fitting. As it is run, the lateral bore completion string is deflected by the completion deflector into the lateral wellbore. The junction fitting may conform with one of the levels defined by the Technology Advancement for Multilaterals (TAML) Organization, for example a TAML Level 5 multilateral junction. The junction fitting may include a stinger connector, which lands within the receptacle connector of the completion deflector, thereby completing the lateral junction.

FIG. 1 is an elevation view in partial cross-section of a well system, generally designated 9, according to an embodiment. Well system 9 may include drilling, completion, servicing, or workover rig 10. Rig 10 may be deployed on land or used in association with offshore platforms, semi-submersible, drill ships and any other well system satisfactory for completing a well. Rig 10 may be located proximate well head 11, or it may be located at a distance, as in the case of an offshore arrangement. A blow out preventer, christmas tree, and/or other equipment associated with servicing or completing a wellbore (not illustrated) may also be provided at well head 11. Similarly, rig 10 may include a rotary table and/or top drive unit (not illustrated).

In the illustrated embodiment, a wellbore 12 extends through the various earth strata. Wellbore 12 may include a substantially vertical section 14. Wellbore 12 has a main wellbore 13, which may have a deviated section 18 that may extend through a first hydrocarbon bearing subterranean formation 20. Deviated section 18 may be substantially horizontal. As illustrated, a portion of main wellbore 13 may be lined with a casing string 16, which may be joined to the formation with casing cement 17. A portion of main wellbore 13 may also be open hole, i.e., uncased. Casing 16 may terminate at its distal end with casing shoe 19.

Figure 2:
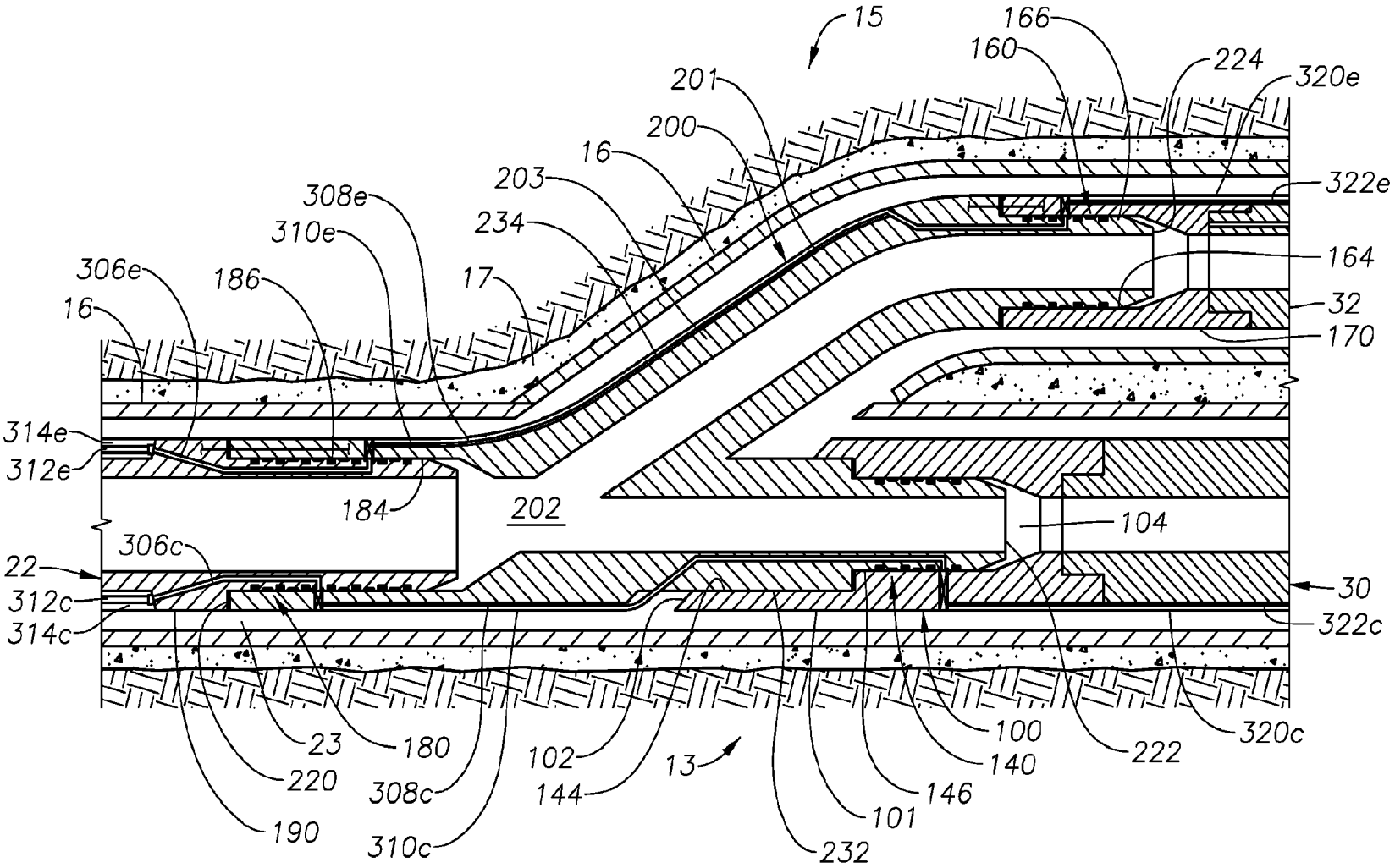
FIG. 2 is an enlarged elevation view in cross section of completion deflector and junction fitting of FIG. 1, showing detail of communication line segments, a main leg connector pair, a lateral leg connector pair, and a trunk connector pair.

Wellbore 12 may include at least one lateral wellbore 15, which may be open hole as illustrated in FIG. 1, or which may include casing 16, as shown in FIG. 2. Lateral wellbore 15 may have a substantially horizontal section which may extend the through the first formation 20 or through a second hydrocarbon bearing subterranean formation 21. According to one or more embodiments, wellbore 12 may include multiple lateral wellbores 9 (not expressly illustrated).

Positioned within wellbore 12 and extending from the surface may be a tubing string 22. An annulus 23 is formed between the exterior of tubing string 22 and the inside wall of wellbore 12 or casing string 16. Tubing string 22 may provide a sufficiently large internal flow path for formation fluids to travel from formation 20 to the surface (or vice versa in the case of an injection well), and it may provide for workover operations and the like as appropriate. Tubing string 22, which may also include an upper completion segment, may be coupled to an uphole end of junction fitting 200, which in turn may be coupled to main completion string 30 and lateral completion string 32. Junction fitting 200 may have a generally wye-shaped body 201 that defines an interior 202, which may fluidly join main completion string 30, lateral completion string 32, and tubing string 22 together.

Each completion string 30, 32 may include one or more filter assemblies 24, each of which may be isolated within the wellbore by one or more packers 26 that may provide a fluid seal between the completion string and wellbore wall. Filter assemblies 24 may filter sand, fines and other particulate matter out of the production fluid stream. Filter assemblies 24 may also be useful in autonomously controlling the flow rate of the production fluid stream.

Each completion string 30, 32 may include one or more downhole gauges 27 and/or downhole flow control valves 28, thereby enabling efficient and selectively controlled commingled production from formations 20 and 21 using intelligent well technology. Accordingly, although not expressly shown in FIG. 1, well system 9 may include one or more communication, control and/or power lines (hereinafter simply communication line(s) for brevity) (not illustrated) passing between the surface and the downhole gauges 27 and/or downhole flow control valves 28 in main completion string 30 for monitoring reservoir 20 and for remote zonal control. Similarly, well system 9 may include one more communication lines passing between the surface and the downhole gauges 27 and/or downhole flow control valves 28 in lateral completion string 32 for monitoring reservoir 21 and for remote zonal control.

Communication lines may include electrical, hydraulic, and fiber optic lines, for example. Each communication line may consist of multiple communication line segments, which may correspond to various strings, subs, tools, fittings, and the like, or portions thereof. Such communication line segments may be interconnected using "wet-connect" "stabable" connector pairs.

As used herein, the term "connector pair" refers to a complete connection assembly consisting of a plug, or stinger connector together with a complementary receptacle connector, whether the connector pair is in mated state or a disconnected state. Wet-connect connector pairs may be sealed and designed so that the mating process displaces environmental fluid from the contact regions, thereby allowing connection to be made when submerged. Stabable connector pairs may be arranged so that the stinger connector is self-guided into proper alignment and mating with the receptacle connector, thereby simplifying remote connection.

Electrical, optical, and/or hydraulic communication lines may be discretely run between the surface and main wellbore 13 and between the surface and lateral wellbore 15 (FIGS. 1 and 2). Alternatively, such electrical, optical and/or hydraulic communication lines may be tied together, in a bus architecture for example, and a suitable addressing scheme employed to selectively communicate with, control and/or provide power to downhole gauges 27 and/or downhole flow control valves 28 (FIG. 1).

Well system 9 may include a completion deflector 100, which together with a junction fitting 200, mechanically connects and fluidly joins main and lateral completion strings 30, 32 with tubing string 22. Junction fitting 200 may be connectable to completion deflector 100 within wellbore 12.

Junction fitting 200 may be formed of a generally wye-shaped hollow body 201 that may define an interior 202. Body 201 may further define an uphole end joined to downhole main and lateral ends by main and lateral legs, respectively, of body 201. The uphole end and the downhole main and lateral ends may be each open to interior 202 of junction fitting 200. Junction fitting 200 may be asymmetrical, wherein the main leg may be shorter than the lateral leg, for example. Although not expressly illustrated, prior to installation in wellbore 12, the main and lateral legs of body 201 may be generally parallel, adjacent one another, and dimensioned so as to fit within wellbore 12. Once installed, as described in detail below, the lateral leg of body 201 may bend away from the main leg of body 201 as it is deflected by completion deflector 100 into lateral wellbore 15.

Completion deflector 100 may include a body having an inclined surface with a profile that laterally deflects equipment which contacts the surface. Completion deflector 100 may include a longitudinal internal passage formed therethrough, which may be dimensioned so that larger equipment is deflected off of its inclined surface, while smaller equipment is permitted to pass therethrough.

Junction fitting 200 may be fluidly and mechanically connected at the downhole main end to main completion string 30 via main leg connector pair 140. Main leg connector pair 140 may include a receptacle connector, which may be located within completion deflector 100, and a stinger connector, which may be located at the downhole main end of junction fitting 200. Main leg connector pair 140 may be wet-matable and stabable, as described in greater detail below.

Junction fitting 200 may be fluidly and mechanically connected at the downhole lateral end to lateral completion string 32 via a lateral leg connector pair 160 and at the uphole end to tubing string 22 via a trunk connector pair 180. Although lateral leg and trunk connector pairs 160, 180 are shown in FIG. 1 as being wet-matable and stabable, in one or more embodiments more conventional arrangements, such as pin and box connectors (not illustrated), may be used.

In addition to mechanical connection and fluidly coupling the interiors of completion strings 30, 32 and tubing string 22 to interior 202 of junction fitting 200, connector pairs 140, 160, 180 may serve to connect electrical, hydraulic, and/or fiber optic communication line segments for implementing intelligent well control in both main wellbore 13 and lateral wellbore 15.

Each completion string 30, 32 may also include an anchoring device 29 to hold the completion string in place in wellbore 12, as described in greater detail hereafter. In one or more embodiments, anchoring device 29 may be a tubing hanger or a packer.

Main and lateral completion strings 30, 32 may equally be used in an open hole environments or in cased wellbores. In the latter case, casing 16, casing cement 17, and the surrounding formation may be perforated, such as by a perforating gun, creating openings 31 for flow of fluid from the formation into the wellbore.

Figure 3:
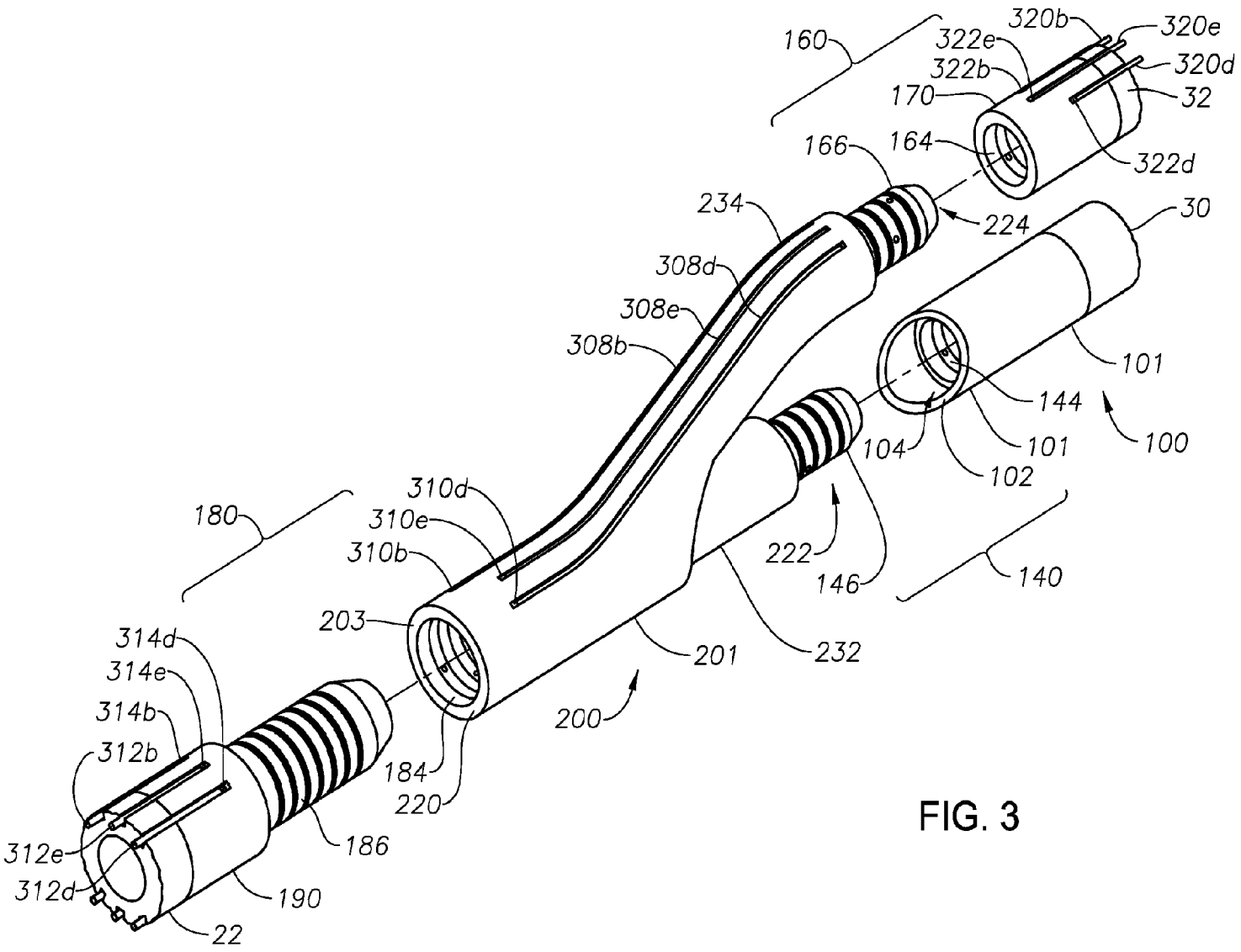
FIG. 3 is an exploded perspective view from a first vantage point of the completion deflector and junction fitting of FIG. 2, showing communication line segments running from the trunk connector pair to the lateral leg connector pair within grooves formed in the exterior wall of the junction fitting body.
Figure 4:
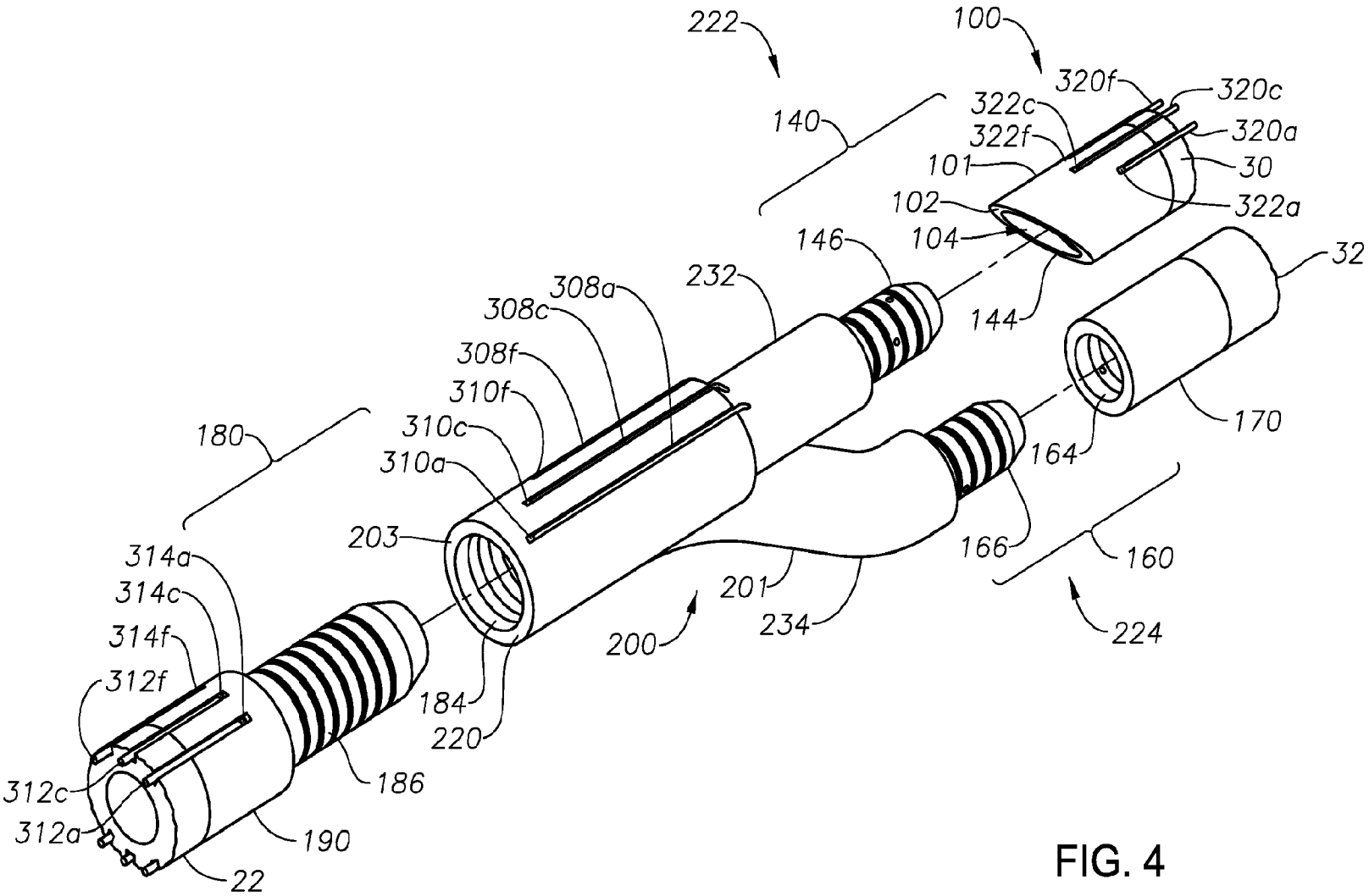
FIG. 4 is an exploded perspective view from a second vantage point opposite the first vantage point of FIG. 3 of the completion deflector and junction fitting of FIG. 2, showing communication line segments running from the trunk connector pair to the main leg connector pair within grooves formed in the exterior wall of the junction fitting body.

FIG. 2 is a cross section of junction fitting 200 mated with completion deflector 100 according to an embodiment. FIGS. 3 and 4 are exploded perspective views of two opposing sides of junction fitting 200 and completion deflector 100, respectively. Referring to FIGS. 2-4, junction fitting 200 may have a generally wye-shaped hollow body 201 with walls 203 that may define interior 202. Body 201 may further define an uphole end 220 joined to downhole main and lateral ends 222, 224 by main and lateral legs 232, 234, respectively. Uphole end 220 and downhole main and lateral ends 222, 224 may be open to interior 202. To simplify installation within wellbore 12, junction fitting 200 may be asymmetrical, wherein main leg 232 is shorter than the lateral leg 234, as described hereinafter.

Completion deflector 100 may be attached to the uphole end of main completion string 30. Main completion string 30 preferably includes anchoring device 29 (FIG. 1), such as a tubing hanger or packer, which holds main completion string 30, including completion deflector 100, in place in main wellbore 13.

Completion deflector 100 may include a body 101 having an inclined surface 102 on the uphole end of body 101 with a profile that laterally deflects equipment which contacts the surface. Completion deflector 100 may also include a longitudinal internal passage 104 formed therethrough. Internal passage 104 may be dimensioned so that larger equipment is deflected off of inclined surface 102, while smaller equipment is permitted to pass through passage 104, thereby enabling equipment to be selectively conveyed into the lateral wellbore 15 or into the main wellbore 13 below completion deflector 100 as desired. In this manner, completion deflector 100 may deflect the distal end of lateral completion string 32 into lateral wellbore 15 as it is run in the well.

In an embodiment, main leg connector pair 140 may include receptacle connector 144, which may be located within internal passage 104 of completion deflector 100, and stinger connector 146, which may be located at downhole main end 222 of junction fitting 200. Similarly, lateral leg connector pair 160 may include receptacle connector 164, which may be located in a sub 170 at the uphole end of lateral completion string 32, and stinger connector 166, which may be located at the downhole lateral end 224 of junction fitting 200. Stinger connector 166, which may be located on the longer lateral leg 234 of wye-shaped junction fitting 200, may have a dimension that causes it to be deflected by inclined surface 102 of completion deflector 100 into lateral wellbore 15.

In an embodiment, completion deflector 100 may first be installed in main wellbore 13 together with main completion string 30. Inclined surface 102 of completion deflector 100 may be located adjacent or in proximity to the lateral junction. As lateral completion string 32 is run into wellbore 12, the distal end of lateral completion string 32, which may have a dimension larger than internal passage 104 of completion deflector 100 (and which in some embodiments may have a "bull nose" or similar shape (not illustrated) to enhance deflection), contacts inclined surface 102 and is directed into lateral wellbore 15. Lateral completion string 32 may then be run into lateral wellbore 15 and then suspended therein by anchoring device 29 (FIG. 1). Junction fitting 200 may be subsequently installed. Stinger connector 166, located on the longer lateral leg 234, may first contact inclined surface 102 and because of its larger diameter be directed into lateral wellbore 15 and stabbed into receptacle connector 164. Stinger connector 166 may include an "bull nose" or similarly shaped outer shroud (not illustrated) to enhance deflection, which may be shearably retained in place until stinger connector 166 engages receptacle connector 164. Main and lateral completion strings 30, 32 may be positioned within wellbore 12 so that as stinger connector 164 is being stabbed into receptacle connector 164 in lateral wellbore 15, stinger connector 146 is being concurrently stabbed into receptacle connector 144 in main wellbore 13.

In another embodiment, main leg connector pair 140 may include receptacle connector 144, which may be located within internal passage 104 of completion deflector 100, and stinger connector 146, which may be located at the downhole main end of junction fitting 200. However, unlike the embodiment above, lateral leg connector pair 160 may be joined prior to being positioned in wellbore 12. As with the previous embodiment, main completion string 30 and completion deflector 100 may be first installed in main wellbore 13, with inclined surface 102 positioned adjacent the lateral junction. However, lateral completion string 32 may be connected to downhole lateral end 224 of junction fitting 200 at the surface, and they may be run into wellbore 12 together. The distal end of lateral completion string 32 may be dimensioned to be larger than internal passage 104 of completion deflector 100 (and in some embodiments may have a "bull nose" or similar shape to enhance deflection) and therefore be directed into lateral wellbore 15 by inclined surface 102. Lateral completion string 32 may be run into lateral wellbore 15 until stinger connector 146 engages and is stabbed into receptacle connector 144 at completion deflector 100. Although joined prior to being run into wellbore 12, lateral leg connector pair 160 may be arranged so as to be disconnectable in situ so that junction fitting 200 may at a later time be pulled from the well to allow access to lateral completion string 32 with larger diameter tools, for example.

In one or more embodiments, trunk connector pair 180 may be a stabable, wet-matable connector arrangement that may include receptacle connector 184, which may be located at the uphole end of junction fitting 200, and stinger connector 186, which may be located at the bottom end of sub 190 at the downhole end of tubing string 22. In other embodiments, trunk connector pair 180 may include non-stabable connectors, such as a threaded pin and box connectors (not illustrated).

In addition to connecting the interiors of completion strings 30, 32 and tubing string 22 to interior 202 of junction fitting 200, connector pairs 140, 160, 180 may serve to connect electrical, hydraulic, and/or fiber optic communication line segments for implementing intelligent well control in both main wellbore 13 and lateral wellbore 15. In the particular embodiment illustrated in FIGS. 2-4, trunk connector pair 180 connects two or more discrete hydraulic communication line segments 312 (in this case shown as 312*a*-312*f*) carried by tubing string 22 and extending to the surface with two or more discrete hydraulic communication line segments 308 (in this case shown as 308*a*-308*f*), respectively, carried by junction fitting 200. Junction fitting 200 routes one or more of these hydraulic communication line segments 308*a*, 308*c*, 308*f* to main leg connector pair 140 and one or more hydraulic communication line segments 308*b*, 308*d*, 308*e* to lateral completion connector 160. Main leg connector pair 140 in turn connects the one or more hydraulic communication line segments 308*a*, 308*c*, 308*f* from junction fitting 200 to discrete hydraulic communication line segments 320*a*, 320*c*, 320*f* carried by completion deflector 100 and main completion string 30 for ultimate connection to downhole gauges 27 and downhole flow control valves 28 (FIG. 1), for example, within main wellbore 13. Likewise, lateral leg connector pair 160 connects the one or more hydraulic communication line segments 308*b*, 308*d*, 308*e* from junction fitting 200 to discrete hydraulic communication line segments 320*b* 320*d*, 320*e* carried by sub 170 and lateral completion string 32 for ultimate connection to downhole gauges 27 and downhole flow control valves 28 (FIG. 1), for instance, within lateral wellbore 15.

Although six hydraulic communication lines are illustrated, a routineer recognizes that any suitable number of hydraulic communication lines may be used. Moreover, junction fitting 200 need not split the hydraulic communication lines evenly between main completion string 30 and lateral completion string 32.

In one or more embodiments, hydraulic communication line segments 312*a*-312*f* may be substantially located within longitudinal grooves 314*a*-314*f* formed along the exterior wall of sub 190; hydraulic communication line segments 308*a*-308*f* may be substantially located within longitudinal grooves 310*a*-310*f* formed along the exterior surface of wall 203 of junction fitting 200; hydraulic communication line segments 320*a*, 320*c*, 320*f* may be substantially located within longitudinal grooves 322*a*, 322*c*, 322*f* formed along the exterior wall surfaces of completion deflector 100 and main completion string 30; and hydraulic communication line segments 320*b* 320*d*, 320*e* may be substantially located within longitudinal grooves 322*b*, 322*d*, 322*c* formed along the exterior wall surfaces of sub 170 and lateral completion string 32. Although such hydraulic communication line segments are shown as being substantially located separately in individual grooves, in one or more embodiments (not illustrated), multiple communication line segments may be collocated within a single longitudinal groove.

Figure 5:
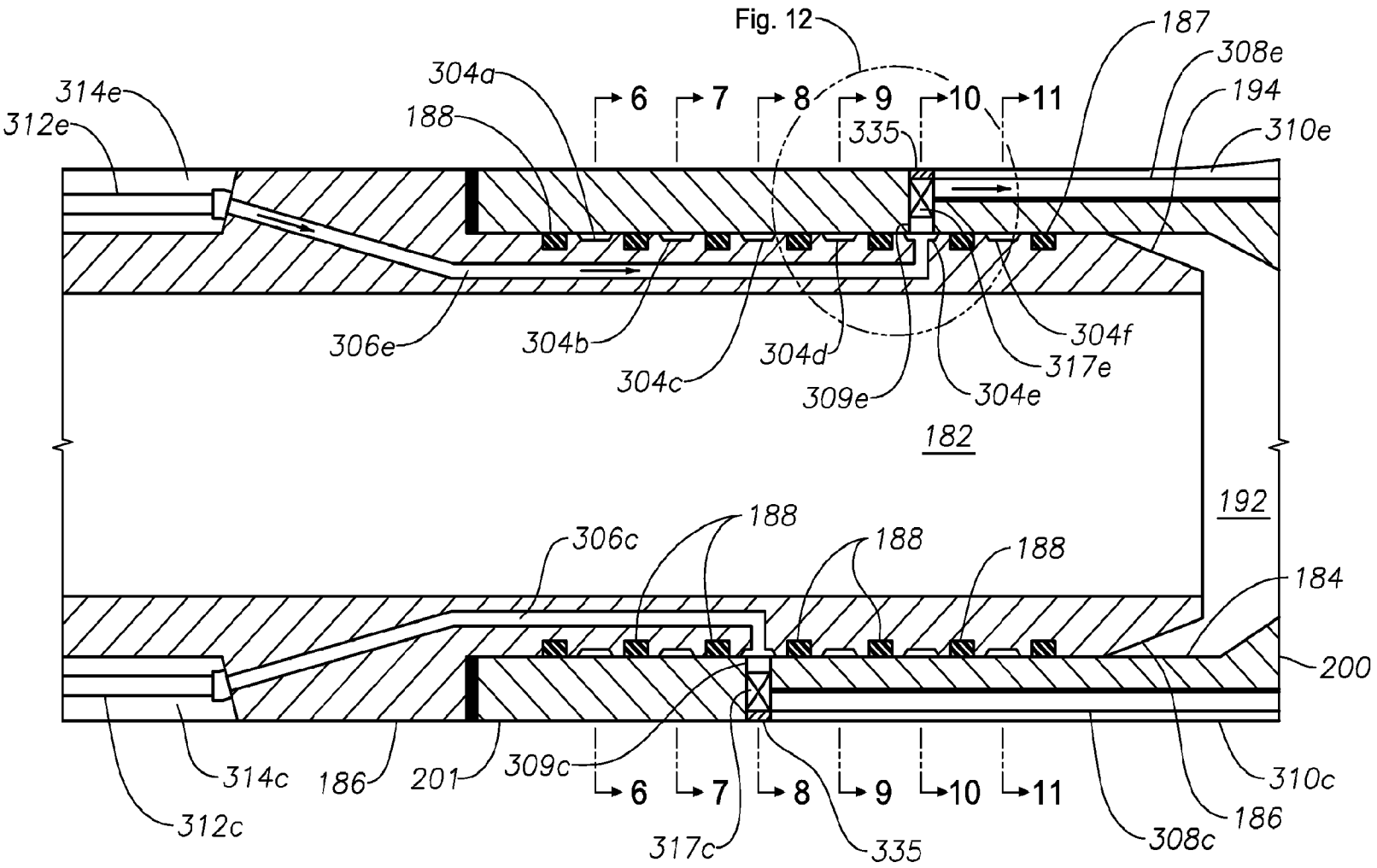
FIG. 5 is an axial cross section of the trunk connector pair of FIG. 2 that connects the tubing string to the junction fitting, showing an axial arrangement of hydraulic connections.
Figure 6:
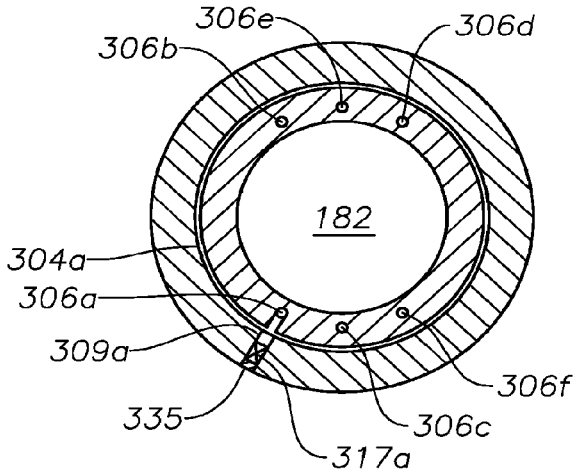
FIG. 6 is transverse cross section of the trunk connector pair of FIG. 5 taken along line 6-6 of FIG. 5.
Figure 7:
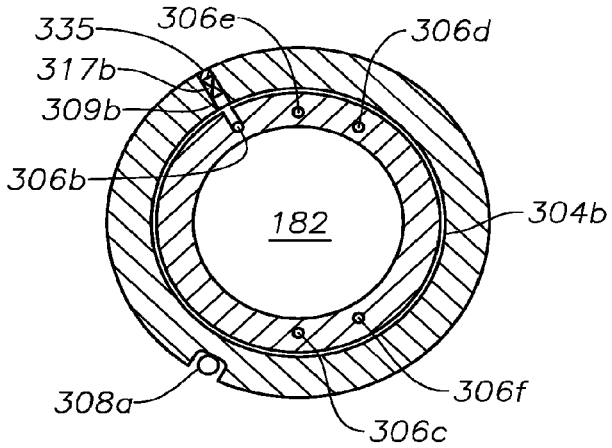
FIG. 7 is transverse cross section of the trunk connector pair of FIG. 5 taken along line 7-7 of FIG. 5.
Figure 8:
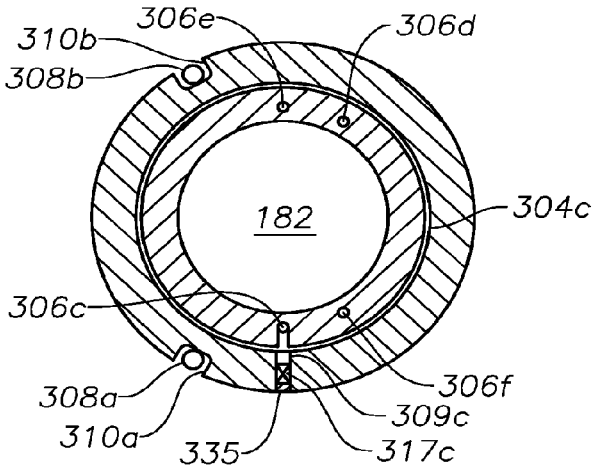
FIG. 8 is transverse cross section of the trunk connector pair of FIG. 5 taken along line 8-8 of FIG. 5.
Figure 9:
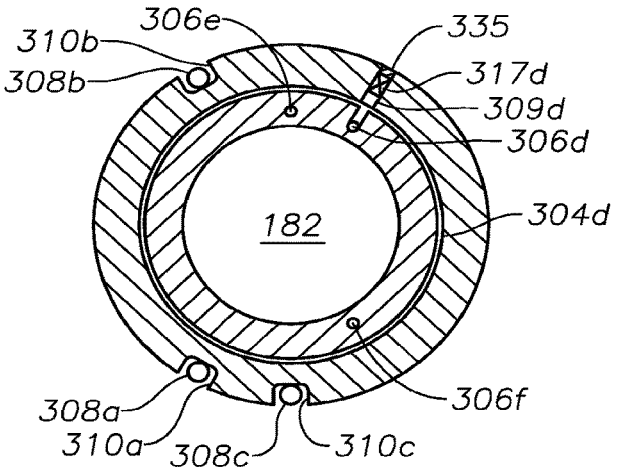
FIG. 9 is transverse cross section of the trunk connector pair of FIG. 5 taken along line 9-9 of FIG. 5.
Figure 10:
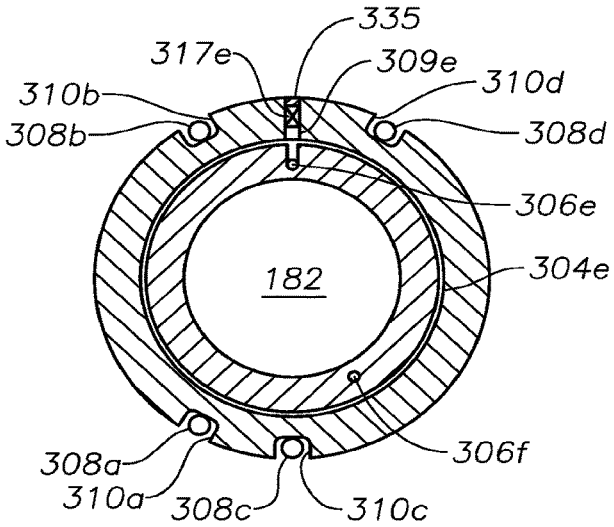
FIG. 10 is transverse cross section of the trunk connector pair of FIG. 5 taken along line 10-10 of FIG. 5.
Figure 11:
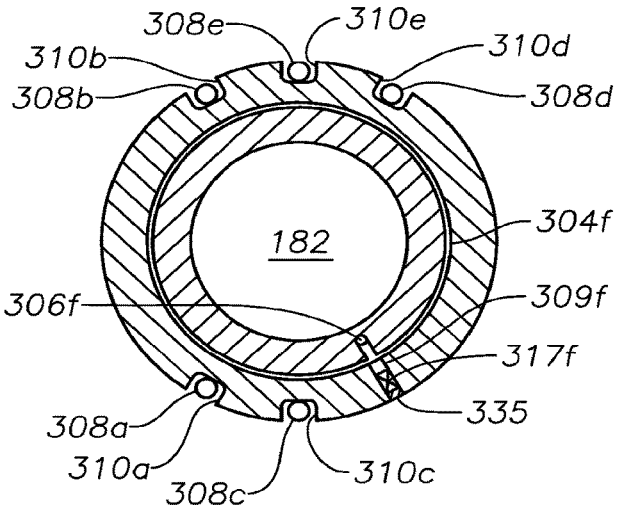
FIG. 11 is transverse cross section of the trunk connector pair of FIG. 5 taken along line 11-11 of FIG. 5.

According to an embodiment, FIG. 5 is an enlarged lateral cross section of the stabable, wet-matable trunk connector pair 180 of FIGS. 2-4 when mated, and FIGS. 6-11 are transverse cross sections of stinger connector 186 of trunk connector pair 180. Referring now to FIGS. 5-11, stinger receptacle 184 may include a cylindrical socket 192, which may be in communication with interior 202 of junction 200 for transfer of production or injection fluids and for conveyance of other strings or workover tools, as may be required from time to time.

Stinger connector 186 may include a distal, generally cylindrical probe 194 which may be dimensioned to be plugged into socket 192. Stinger connector 186 may include a central bore 182, which may be in communication with the interior of tubing string 22 via sub 190 for transfer of production or injection fluids and for conveyance of other strings or workover tools, as may be required from time to time. When stinger connector 186 is mated within receptacle connector 184, bore 182 may be in sealed fluid communication with socket 192, and in turn with interior 202 of junction 200. O-ring 187 may provide a seal between bore 182 and socket 192.

In some embodiments, hydraulic communication line segments 312*a*-312*f*, which may be exteriorly located within longitudinal grooves 314*a*-314*f* formed along the exterior wall surface of sub 190 (FIGS. 3 and 4) and connected to respective to hydraulic communication line segments 306*a*-306*f*, which may be formed as interior flow channels within the wall of stinger connector 186. Flow channels 306*a*-306*f* may be radially distributed within the wall of stinger connector 186. Accordingly, only two such flow channels, 306*c*, 306*e*, are visible in the cross section of FIG. 5. Trunk connector pair 180 may seal and fluidly connect flow channels 306*a*-306*f* within stinger connector 186 to corresponding hydraulic communication line segments 308*a*-308*f*, which may be located within longitudinal grooves 310*a*-310*f* formed along the exterior of wall 203 of junction fitting 200.

In some embodiments, trunk connector pair 180 may be designed to allow connection of hydraulic communication line segments without regarding to the relative radial orientation of stinger connector 186 within receptacle connector 184. In particular, there may be provided axially spaced circumferential grooves 304*a*-304*f* formed about probe 194 of stinger connector 186, one for each flow channel 306*a*-306*f*. Each circumferential groove 304*a*-304*f* may be in fluid communication with its respective flow channel 306*a*-306*f*.

When probe 194 of stinger connector 186 is located within socket 192 of receptacle 184, circumferential grooves 304*a*-304*f* may be isolated from one another by O-rings 188 and from central bore 182 by O-ring 187.

When trunk connector pair 180 is in a mated condition, each circumferential groove 304*a*-304*f* may axially align with and be in fluid communication with a respective port 309*a*-309*f*. Such axially spaced circumferential grooves 304*a*-304*f* may define communication line connection points. Ports 309*a*-309*f* may be formed within or through wall 203 of junction fitting 200 and open into socket 192. As with flow channels 306*a*-306*f*, ports 309*a*-309*f* may be radially distributed about socket 192. Accordingly, fluid may flow from flow channel 306*e*, around circumferential groove 304*e* within socket 192, and into port 309*e*, for example, regardless of the relative radial orientation of stinger connector 186 with respect to receptacle connector 184. Ports 309*a*-309*f* may in turn be fluidly coupled to corresponding hydraulic communication line segments 308*a*-308*f*. In one or more embodiments, a valve assembly 317 may be provided within port 309 to isolate communication line segment 308 when trunk connector pair 180 is in a disconnected state, as described in greater detail below.

Figure 12A:
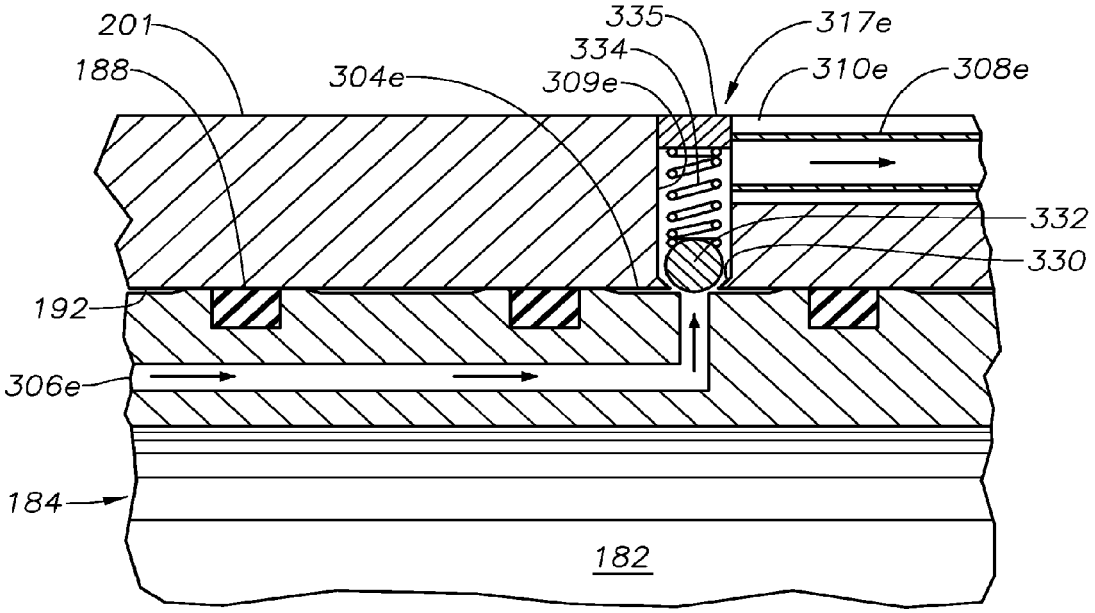
FIGS. 12A and 12B are enlarged cross sections of a portion of the trunk connector pair of FIG. 5 according to first and second embodiments, showing details of a check valve assembly for isolating the hydraulic communication lines within the junction fitting when the trunk connector pair is in a disconnected state.
Figure 12B:
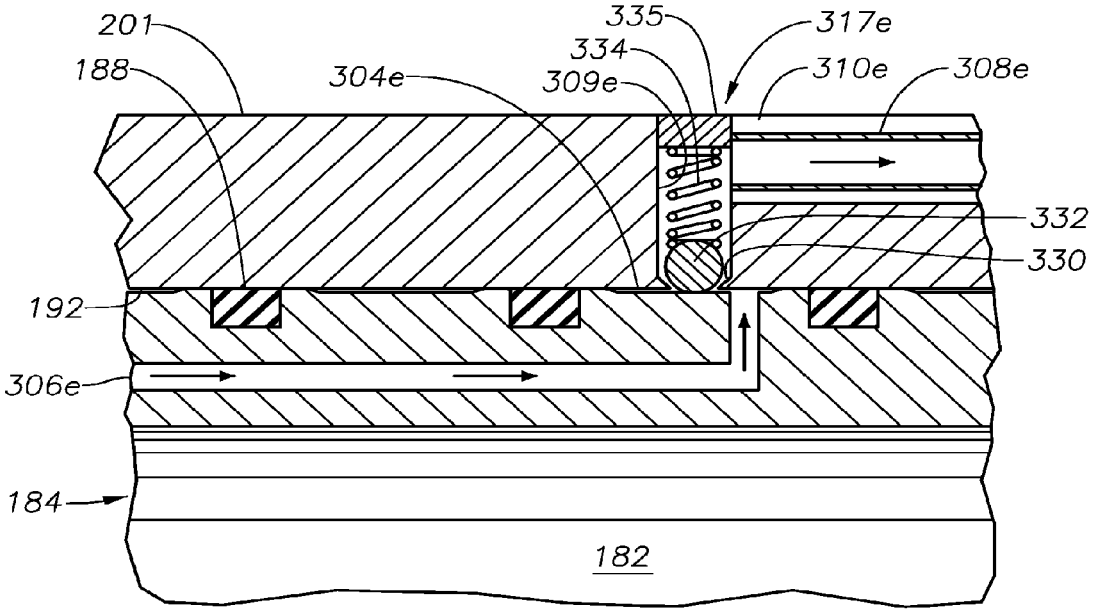

FIGS. 12A and 12B are enlarged cross sections of a portion of trunk connector pair 180 of FIG. 5 according to first and second embodiments, respectively, which, by way of exemplary port 309*e*, provide details of check valve assemblies 317 located within ports 309*a*-309*f* for isolating hydraulic communication line segments 308*a*-308*f* at junction fitting 200 when trunk connector pair 180 is in a disconnected state, such as when tubing string 22 is being run in wellbore 12 (FIG. 1). In some embodiments, port 309*e* may define a tapered valve seat 330 that opens into socket 192 at the axial location of its respective circumferential groove 304*e*. Although the disclosure is not limited to a particular type of valve assembly 317, within port 309*e*, a check ball 332 may be urged against valve seat 330 by a spring 334, secured in place by a plug 335. When check ball 332 is in contact with valve seat 330, the corresponding hydraulic communication line segment 308*e* may be isolated from socket 192. In the embodiment of FIG. 12A, when the differential fluid pressure acting on check ball 332 creates an opening force that exceeds the force of spring 334 against check ball 332, then check ball 332 may unseat, allowing fluid communication between groove 304*e* and hydraulic communication line segment 308*e*. In the embodiment of FIG. 12B, when trunk connector pair 180 is in a disconnected state, seated check ball 332 may physically protrude into socket 192. When probe 194 is seated within socket 192, probe 194 may displace check ball 332 off of its seat, allowing fluid communication between groove 304*e* and hydraulic communication line segment 308*e*. In the embodiment of FIG. 12B, because probe 194 may continuously maintain check ball 332 in an unseated condition, pressure downhole of valve seat 330 can be monitored and relieved from the surface.

Figure 13:
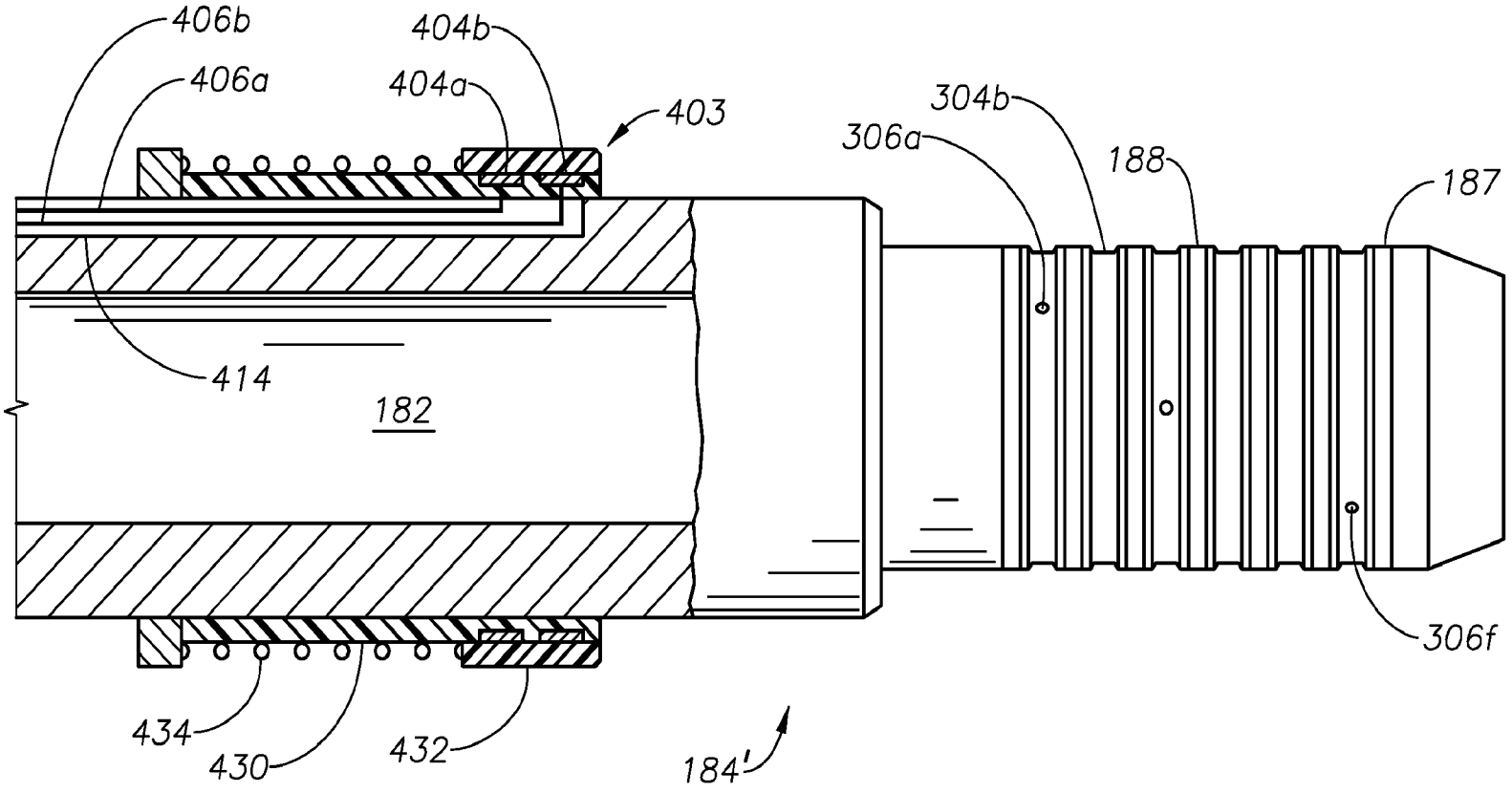
FIG. 13 is an elevation view in partial cross section of the stinger connector of the trunk connector pair according to an embodiment, showing sealed electrical connections.
Figure 14:
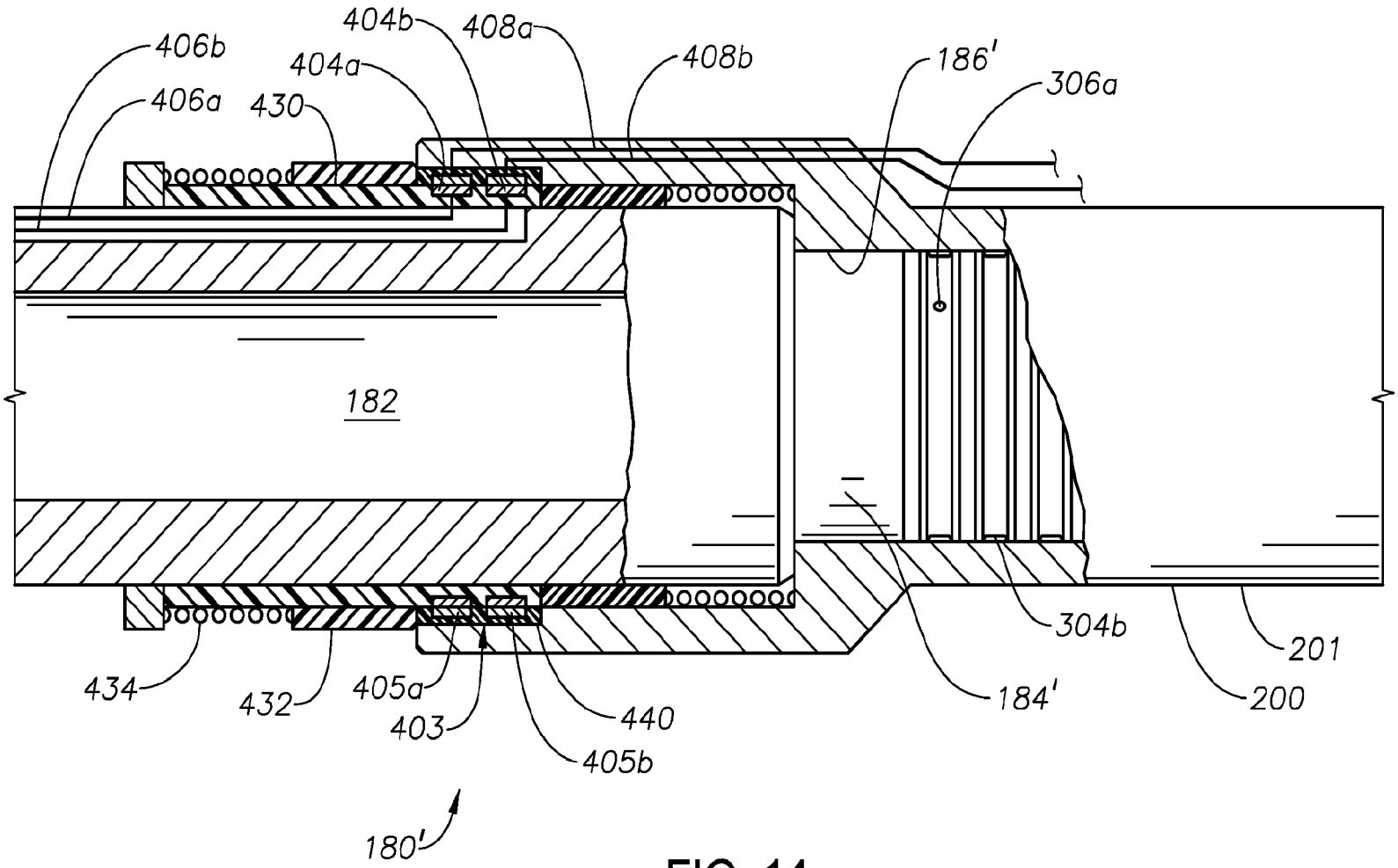
FIG. 14 an elevation view in partial cross section of the stinger connector of the trunk connector pair of FIG. 14 mated with the receptacle connector of the trunk connector pair.

FIGS. 13 and 14 are elevation views in partial cross section of trunk connector pair 180' according to one or more embodiments, in which electrical and/or optical communication line segments 406*a*, 406*b* may be sealingly connected to corresponding electrical and/or optical communication line segments 408*a*, 408*b* via electrical slip rings or fiber optic rotary joints (hereinafter simply slip ring assemblies 403). Although two electrical and/or optical communication lines are illustrated and described herein, a routineer recognizes that any suitable number of electrical and/or optical communication lines may be used. Electrical and/or optical communication lines may be discretely run between the surface and main wellbore 13 and between the surface and lateral wellbore 15 (FIGS. 1 and 2). Alternatively, electrical and/or optical communication lines may be tied together, in a bus architecture for example, and a suitable addressing scheme employed to selectively communicate with downhole gauges 27 and/or downhole flow control valves 28 (FIG. 1).

Referring to FIG. 13, stinger connector 184' of trunk connector pair 180' may optionally include a number of hydraulic communication line segments 312*a*-312*f*, flow channel communication line segments 306*a*-306*f*, circumferential grooves 304*a*-304*f*, and O-rings 187, 188 (see FIGS. 5-11), as described above. Stinger connector 184' may carry inner members 404*a*, 404*b* of slip ring assemblies 403, which may be connected to electrical/optical communication line segments 406*a*, 406*b*. Electrical/optical communication line segments 406*a*, 406*b* may extend to the surface along tubing string 22 (FIG. 1). In one or more embodiments, electrical/optical communication line segments 406 may be strapped along the outer wall of tubing string 22. In such an embodiment, the exterior wall surfaces of stinger connector 184', sub 190, and tubing string 22 (FIGS. 2-4) may include one or more longitudinal grooves 414 formed therein, in which electrical/optical communication line segments 406 may be located. Electrical/optical communication line segments 406*a*, 406*b* may be located individually within groove(s) 414, as shown, or they may be located within one or more conduit pipes (not illustrated), which may in turn be located within groove(s) 414.

In the case of electrical slip rings, inner members 404*a*, 404*b* may be separated by a dielectric separating member 430 to provide insulation and prevent short circuiting. In an embodiment, inner members 404*a*, 404*b* may be covered by a retractable sleeve 432 when trunk connector pair 180' is in a disconnected state. Sleeve 432 preferably includes an electrically insulating material in the case of electrical slip rings. Sleeve 432 may function to seal against inner members 404*a*, 404*b* and separating member 430 in order to keep the electrical/optical surfaces of inner members 404*a*, 404*b* clean. Sleeve 432 may be urged into position to cover inner members 404*a*, 404*b* by spring 434.

FIG. 14 illustrates trunk connector pair 180' in a connected state, in which stinger connector 184' is received into receptacle connector 186'. Receptacle connector 186' may include a number of ports 309*a*-309*f*, hydraulic communication line segments 308*a*-308*f*, and longitudinal grooves 310*a*-310*f* (see FIGS. 5-11), as described above. Receptacle connector 186' may carry outer members 405*a*, 405*b* of slip ring assemblies 403 at axial locations on an inner circumferential surface of receptacle connector 186' to make rotational contact with corresponding inner members 404*a*, 404*b*. The axial locations of member pairs 404*a*, 405*a* and 404*b*, 405*b* may define communication line connection points. Outer members 405*a*, 405*b* may be connected to electrical/optical communication line segments 408*a*, 408*b*, which may be routed, for example, within bores formed within wall 203 and/or grooves formed along the exterior surface of wall 203 of junction fitting 200 to main leg connector pair 140 and lateral leg connector pair 160 (FIGS. 2-4) in a manner substantially similar as described above with respect to the hydraulic communication line segments.

In the case of electrical slip rings, outer members 405*a*, 405*b* may be separated by a dielectric separating member 440 to provide insulation and prevent short circuiting. Retractable sleeve 432, if provided, may be displaced away from inner members 404*a*, 404*b* by the uphole end of junction fitting 200 when trunk connector pair 180' is in a connected state, thereby allowing electrical and/or optical contact between the slip ring members.

Various embodiments of wet-matable, stabable trunk connector pair 180, 180' have been illustrated and described in detail herein. In one or more embodiments, main leg connector pair 140 may be substantially similar to such trunk connector pair 180, 180', with perhaps the exception of physical dimensions and the number of communication lines. Because of the similarities and for the sake of brevity, main leg connector pair 140 is not described in further detail herein. Likewise, in embodiments where lateral leg connector pair 160 is a wet-matable, stabable connector assembly, it too may be substantially similar to trunk connector pair 180, 180', with perhaps the exception of physical dimensions and the number of communication lines. Accordingly, lateral leg connector pair 160 is not described in further detail herein.

Although junction fitting 200 has been described as wye-shaped, junction fitting 200 may have any shape selected to correspond with the direction of lateral wellbore 15 branching off from wellbore 13 (FIG. 1). Likewise, junction fitting 200 may have three or more legs for two or more lateral wellbores.

Figure 15:
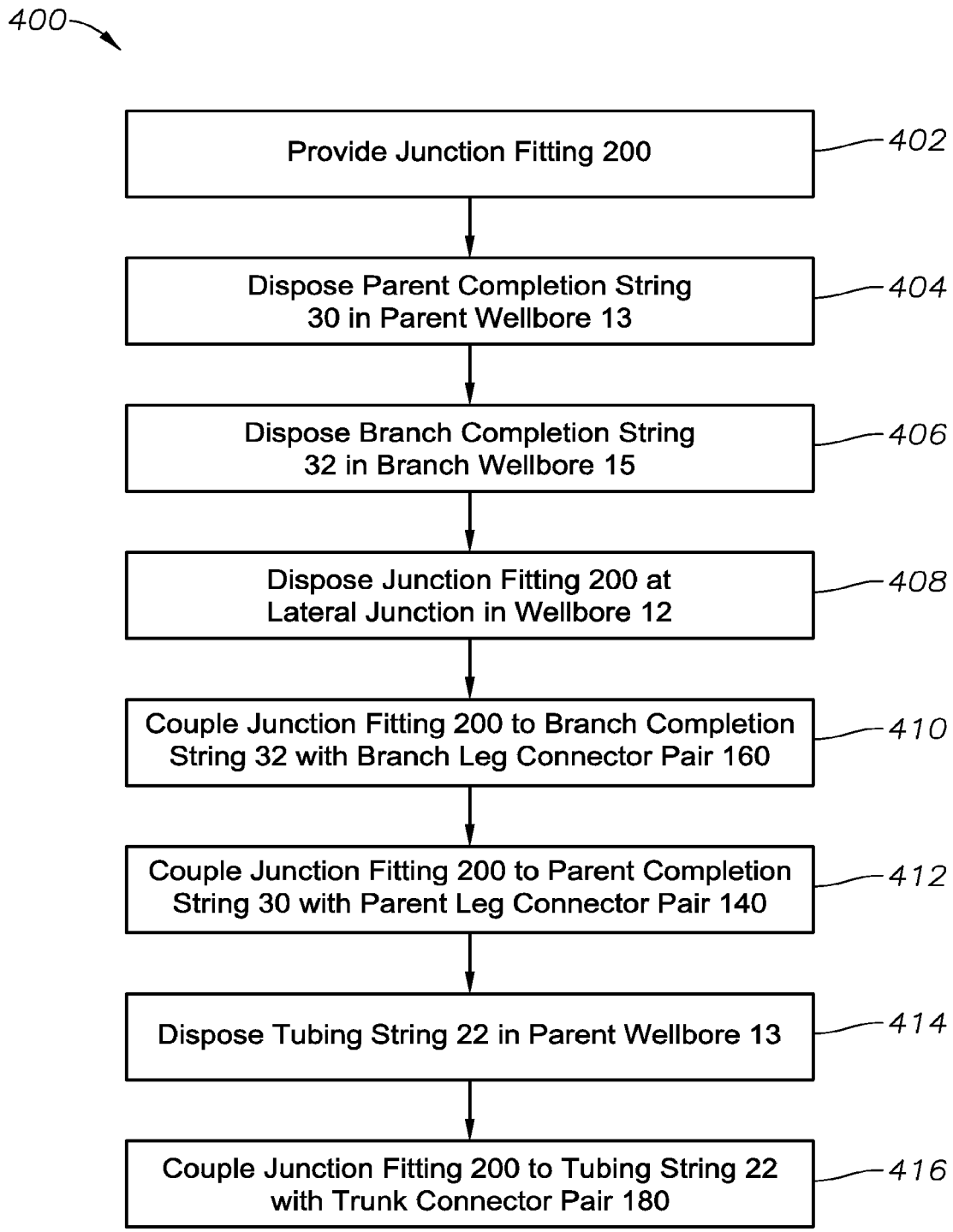
FIG. 15 is a flowchart of a method of completing a lateral junction according to an embodiment using the systems depicted in FIGS. 1-14.

FIG. 15 a flowchart of a method 400 of completing a lateral junction according to an embodiment using the well system 9 (FIGS. 1 and 2). Referring to FIGS. 1, 2, and 15, at step 402 junction fitting 200 may be provided. Junction fitting 200 may have a generally wye-shaped tubular body 201 formed by wall 203 and define hollow interior 202, an exterior surface, uphole end 220, downhole main end 222, and downhole lateral end 224. Uphole end 220 and downhole main and lateral ends 222, 224 may be open to interior 202. Junction fitting 200 may carry a communication line segment 308*c* that forms a mid portion of a first communication line. Communication line segment 308*c* may extend between uphole end 220 and downhole main end 222. Junction fitting 200 may also carry a communication line segment 308*e* that forms a mid portion of a second communication line, which may extend between uphole end 220 and downhole lateral end 224. Communication line segments 308*c*, 308*e* may be located completely outside of interior 202 of junction fitting 200.

At step 404, main completion string 30 may be disposed, as by running in a conventional manner, within main wellbore 13. The uphole end of main completion string 30 may include completion deflector 100, and main completion string 30 may be positioned within wellbore 13 so that inclined surface 102 is located at an elevation at or slightly downhole of the lateral junction. Main completion string 30 may define an interior for flow of production fluids and carry communication line segment 320*c*, which may form a lower portion of the first communication line. Main completion string 30 may be held in position within main wellbore 13 by anchoring device 29.

At step 406, lateral completion string 32 may be disposed in lateral wellbore 15. Lateral completion string 32 may define an interior for flow of production fluids and carry communication line segment 320*e*, which may form a lower portion of the second communication line. Lateral completion string 32 may be held in position within lateral wellbore 15 by anchoring device 29.

At step 408, junction fitting 200 may be disposed at the lateral junction. At step 410, downhole lateral end 224 of junction fitting 200 may be coupled to lateral completion string 32 so that interior 202 of junction fitting 200 is in fluid communication with the interior of lateral completion string 32 and so that communication line segments 308*e*, 320*e*, forming mid and lower portions of the second communication line, are connected. At step 412, downhole main end 222 of junction fitting 200 may be coupled to main completion string 30 so that interior 202 of junction fitting 200 is in fluid communication with the interior of main completion string 30 and so that communication line segments 308*c*, 320*c*, forming mid and lower portions of the first communication line, are connected.

In one embodiment, steps 404 and 410 may occur before steps 406, 408 and 412. Steps 406, 408 and 412 may then be performed concurrently. That is, main completion string 30 may be pre-positioned in main wellbore 13, lateral completion string 32 may be connected to junction 200 at the surface, for example using a pin and box (not illustrated) lateral leg connector pair 160, and lateral completion assembly 32 may be run into wellbore 12 together with junction fitting 200. As junction fitting 200 reaches the intended final position at the lateral junction, downhole main end 222 may engage and is be coupled with main completion string 30, such as by stabbing wet-matable main leg connector pair 140.

In another embodiment, steps 404 and 406 may occur before steps 408, 410 and 412. Then steps 408, 410, and 412 may be performed concurrently. That is, main completion string 30 and lateral completion string 32 may be pre-positioned in main wellbore 13 and lateral wellbore 15, respectively. Junction fitting 200 may then be run into wellbore 12. As junction fitting 200 reaches the intended final position at the lateral junction, both downhole main end 222 and downhole lateral end 224 may simultaneously engage and be coupled with respective main completion string 30 and lateral completion string 32, such as by stabbing wet-matable connector pairs 140, 160.

At step 414, tubing string 22 may be disposed, as by running, in main wellbore 13 uphole of junction fitting 200. Tubing string 22 may define an interior and carry communication line segments 312*c*, 312*e* forming upper portions of the first and second communication lines. At step 416, uphole end 220 of junction fitting 200 may be coupled to tubing string 22 so that interior 202 of junction fitting 200 is in fluid communication with the interior of tubing string 22, so that communication line segments 308*c* and 312*c* forming the mid and upper portions of the first communication line are connected, and so that communication line segments 308*e* and 312*e* forming the mid and upper portions of the second communication line are connected.

In an embodiment, step 408 may occur before steps 414 and 416. Then, steps 414 and 416 may be performed concurrently. That is, junction fitting 200 may be first positioned at the lateral junction. Tubing string 22 may then be run in wellbore 13, and the distal end of tubing string 22 may engage and be coupled with uphole end 220 of junction fitting 200, such as by stabbing a wet-matable trunk connector pair 180.

In another embodiment, steps 408, 412, and 414 may be performed concurrently after step 416 is performed. That is, uphole end 220 of junction fitting 200 may be coupled to tubing string 22 at the surface, such as by a pin and box (not illustrated) trunk connector pair 180. Tubing string 22 and junction fitting 200 may be run into wellbore 12 together. As junction fitting 200 reaches the intended final position at the lateral junction, downhole main end 222 may engage and is be coupled with main completion string 30, such as by stabbing a wet-matable main leg connector pair 140.

In summary, a junction fitting, a well system, and methods for completing a well have been described.

Embodiments of the junction fitting may have: A generally wye-shaped tubular body formed by a wall and defining a hollow interior, an exterior surface, an uphole end, and downhole main and lateral ends, the uphole end and downhole main and lateral ends being open to the interior; a first communication line segment extending between the uphole end and the downhole main end; and a second communication line segment extending between the uphole end and the downhole lateral end; the first and second communication line segments being located completely outside of the interior of the junction fitting.

Embodiments of the well system may have: A junction fitting having a generally wye-shaped tubular body formed by a wall and defining a hollow interior, an exterior surface, an uphole end, and downhole main and lateral ends, the uphole end and downhole main and lateral ends being open to the interior, the junction fitting disposed at an intersection of the main wellbore and the lateral wellbore; a tubing string disposed in the main wellbore uphole of the junction fitting and coupled to the uphole end of the junction fitting, the tubing string defining an interior that is fluidly coupled with the interior of the junction fitting; a main completion string disposed in the main wellbore downhole of the junction fitting and coupled to the downhole main end of the junction fitting, the main completion string having an interior that is fluidly coupled with the interior of the junction fitting; a lateral completion string disposed in the lateral wellbore and coupled to the downhole lateral end of the junction fitting, the lateral completion string having an interior that is fluidly coupled with the interior of the junction fitting; a first communication line extending between the tubing string and the main completion string; and a second communication line extending between the tubing string and the lateral completion string; the first and second communication lines being located completely outside of the interior of the junction fitting.

Embodiments of a method for completing may generally include: Positioning a main completion string in a main wellbore below a junction in the main wellbore, the main completion string defining an interior; positioning a lateral completion string in a lateral wellbore extending from the junction, the lateral completion string defining an interior; then positioning a wye-shaped junction fitting to engage the main and lateral completion strings so as to establish fluid communication between an interior of the junction fitting and the interiors of the main and lateral completion strings, establish communication between the surface of the well and the main completion string via a first communication line segment positioned outside the interior of the junction fitting, and establish communication between the surface of the well and the lateral completion string via a second communication line segment positioned outside the interior of the junction fitting.

Embodiments of a method for completing may also generally include: Providing a junction fitting having a generally wye-shaped tubular body formed by a wall and defining a hollow interior, an exterior surface, an uphole end, and downhole main and lateral ends, the uphole end and downhole main and lateral ends being open to the interior; carrying by the junction fitting a mid portion of a first communication line extending between the uphole end and the downhole main end and a mid portion of a second communication line extending between the uphole end and the downhole lateral end, the mid portions of the first and second communication lines being located completely outside of the interior of the junction fitting; disposing a main completion string in the main wellbore at an elevation downhole of an intersection of the lateral wellbore and the main wellbore, the main completion string defining an interior and carrying a lower portion of the first communication line; disposing a lateral completion string in the lateral wellbore, the lateral completion string defining an interior and carrying a lower portion of the second communication line; disposing the junction fitting at an intersection of the main wellbore and the lateral wellbore; coupling the downhole lateral end of the junction fitting to the lateral completion string so that the interior of the junction fitting is in fluid communication with the interior of the lateral completion string and so that the mid portion of the second communication line is connected to the lower portion of the second communication line; coupling the downhole main end of the junction fitting to the main completion string so that the interior of the junction fitting is in fluid communication with the interior of the main completion string and so that the mid portion of the first communication line is connected to the lower portion of the first communication line; disposing a tubing string in the main wellbore uphole of the junction fitting, the tubing string defining an interior and carrying upper portions of the first and second communication lines; and coupling the uphole end of the junction fitting to the tubing string so that the interior of the junction fitting is in fluid communication with the interior of the tubing string and so that the mid portions of the first and second communication lines are connected to the upper portions of the first and second communication lines.

Any of the foregoing embodiments may include any one of the following elements or characteristics, alone or in combination with each other: A first longitudinal groove formed along the exterior surface, the first communication line segment being at least partially disposed within the first longitudinal groove; a second longitudinal groove formed along the exterior surface, the second communication line segment being at least partially disposed within the second longitudinal groove; a trunk connector located at the uphole end; a main leg connector located at the downhole main end; a lateral leg connector located at the downhole lateral end; the trunk connector, the main leg connector, and the lateral leg connector each including an opening formed therethrough that is in fluid communication with the interior of the junction fitting; the first communication line segment extending between the trunk connector and the main leg connector; the second communication line segment extending between the trunk connector and the lateral leg connector; a third communication line segment extending between the trunk connector and the main leg connector; a fourth communication line segment extending between the trunk connector and the lateral leg connector; the third communication line segment being at least partially disposed within the first longitudinal groove or a third longitudinal groove formed along the exterior surface; the fourth communication line segment being at least partially disposed within the second longitudinal groove or a fourth longitudinal groove formed along the exterior surface; first, second, third and fourth uphole communication line connection points defined by the trunk connector; first and third downhole communication line connection points defined by the main leg connector; second and fourth downhole communication line connection points defined by the lateral leg connector; the first, second, third and fourth communication line segments extending between the first, second, third and fourth uphole and the first, second, third and fourth downhole communication line connection points, respectively; the trunk connector arranged to connect the first, second, third and fourth communication line segments at the first, second, third and fourth uphole communication line connection points and to connect the interior of the junction fitting via the opening of trunk connector; the main leg connector arranged to connect the first and third communication line segments at the first and third downhole communication line connection points and to connect the interior of the junction fitting via the opening of main leg connector; the lateral leg connector arranged to connect the second and fourth communication line segments at the second and fourth downhole communication line connection points and to connect the interior of the junction fitting via the opening of lateral leg connector; the first and third downhole communication line connection points are located at differing first and second axial locations with respect to the main leg connector; each of first, second, third and fourth communication line segments is a type from the group consisting of a hydraulic communication line, an electric communication line, and a fiber optic communication line; the main leg connector is a stinger connector; the trunk connector is a receptacle connector; at least one of the first and third communication line segments is a hydraulic communication line; the trunk connector has a socket and provides an uphole hydraulic communication line connection point at an axial location on the interior surface of the socket that is in fluid communication with the hydraulic communication line; the main leg connector has a cylindrical probe and provides a downhole hydraulic communication line connection point at an axial location on the exterior surface of the probe that is in fluid communication with the hydraulic communication line; a first longitudinal groove formed along the exterior surface of the junction fitting, a mid portion of the first communication line located within the first longitudinal groove; a second longitudinal groove formed along the exterior surface of the junction fitting, a mid portion of the second communication line located within the second longitudinal groove; a trunk connector pair disposed between the tubing string and the junction fitting, the trunk connector pair coupling the interior of the tubing string with the interior of the junction fitting, an upper portion of the first communication line with the mid portion of the first communication line, and an upper portion of the second communication line with the mid portion of the second communication line; a main leg connector pair disposed between the main completion string and the junction fitting, the main leg connector pair coupling the interior of the main completion string with the interior of the junction fitting and a lower portion of the first communication line with the mid portion of the first communication line; a lateral leg connector pair disposed between the lateral completion string and the junction fitting, the lateral leg connector pair coupling the interior of the lateral completion string with the interior of the junction fitting and a lower portion of the second communication line with the mid portion of the second communication line; a third communication line extending between the tubing string and the main completion string; a fourth communication line extending between the tubing string and the lateral completion string; a mid portion of the third communication line located within the first longitudinal groove or a third longitudinal groove formed along the exterior surface of the junction fitting; a mid portion of the fourth communication line located within the second longitudinal groove or a fourth longitudinal groove formed along the exterior surface of the junction fitting; first, second, third and fourth uphole communication line connection points defined by the trunk connector pair; first and third downhole communication line connection points defined by the main leg connector pair; second and fourth downhole communication line connection points defined by the lateral leg connector pair; the mid portions of the first, second, third and fourth communication lines extending between the first, second, third and fourth uphole and the first, second, third and fourth downhole communication line connection points, respectively; the first and third downhole communication line connection points are located at differing first and second axial locations with respect to the main leg connector pair; each of first, second, third and fourth communication lines is a type from the group consisting of a hydraulic communication line, an electric communication line, and a fiber optic communication line; the trunk connector pair includes a receptacle connector located at the uphole end of the junction fitting; main leg connector includes a stinger connector located at the downhole main end of the junction fitting; at least one of the first and third communication lines is a hydraulic communication line; the receptacle connector of the trunk connector pair has a socket and provides a downhole hydraulic communication line connection point at an axial location on the interior surface of the socket that is in fluid communication with the hydraulic communication line; the stinger connector of the downhole main connector pair has a cylindrical probe and provides an uphole hydraulic communication line connection point at an axial location on the exterior surface of the probe that is in fluid communication with the hydraulic communication line; first and second ports located at the downhole hydraulic communication line connection point and the uphole hydraulic communication line connection point, respectively first and second valves disposed within the first and second ports, respectively; at least one of the first and third communication lines is an electrical communication line; the receptacle connector of the trunk connector pair has a socket and provides a downhole electrical communication line connection point at an axial location on the interior surface of the socket that is electrically coupled with the electrical communication line; the stinger connector of the downhole main connector pair has a cylindrical probe and provides an uphole electrical communication line connection point at an axial location on the exterior surface of the probe that is electrically coupled with the electrical communication line; first and second electrical slip rings located at the downhole electrical communication line connection point and the uphole electrical communication line connection point, respectively; at least one of the first and third communication lines is an optical communication line; the receptacle connector of the trunk connector pair has a socket and provides a downhole optical communication line connection point at an axial location on the interior surface of the socket that is optically coupled with the optical communication line; the stinger connector of the downhole main connector pair has a cylindrical probe and provides an uphole optical communication line connection point at an axial location on the exterior surface of the probe that is optically coupled with the optical communication line; first and second optical slip rings located at the downhole optical communication line connection point and the uphole optical communication line connection point, respectively; providing first and second longitudinal grooves along the exterior surface of the junction fitting; disposing the mid portion of the first communication line within the first longitudinal groove; disposing the mid portion of the second communication line within the second longitudinal groove; disposing the main completion string in the main wellbore and coupling the downhole lateral end of the junction fitting to the lateral completion string before disposing the junction fitting at the intersection of the main wellbore and the lateral wellbore; and then coupling the downhole main end of the junction fitting to the main completion string by moving the junction fitting to the intersection of the main wellbore and the lateral wellbore to mate a main leg connector pair; disposing the main completion string in the main wellbore and the lateral completion string in the lateral wellbore before disposing the junction fitting at the intersection of the main wellbore and the lateral wellbore; and then coupling the downhole main end of the junction fitting to the main completion string and the downhole lateral end of the junction fitting to the lateral completion string by moving the junction fitting to the intersection of the main wellbore and the lateral wellbore to mate a main leg connector pair and a lateral leg connector pair; and disposing the junction fitting at the intersection of the main wellbore and the lateral wellbore; and then coupling the uphole end of the junction fitting to the tubing string by running the tubing string into the main wellbore to mate a trunk connector pair.

The Abstract of the disclosure is solely for providing a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A junction fitting for use within a wellbore having at least one lateral branch, comprising:

a generally wye-shaped tubular body formed by a wall and defining a hollow interior, an exterior surface, an uphole end, and downhole main and lateral ends, said uphole end and downhole main and lateral ends being open to said interior;

a first communication line segment extending between said uphole end and said downhole main end; and a second communication line segment extending between said uphole end and said downhole lateral end;

said first and second communication line segments being located completely outside of said interior of said junction fitting;

wherein a port is formed through the wall of the wye-shaped tubular body and defining a first opening facing towards the hollow interior and a second opening formed through the exterior surface;

wherein the wall forms a tapered valve seat around the first opening;

wherein the junction fitting further comprises a valve assembly that is movable between a first configuration and a second configuration, the valve assembly comprising:

a plug within the second opening;

a check ball within the port; and a spring between the check ball and the plug, wherein the spring urges the check ball against the tapered valve seat;

wherein, in the first configuration, the check ball is seated in the tapered valve seat to fluidically isolate the first communication line segment from the hollow interior;

wherein, in the first configuration, at least a portion of the check ball protrudes into the hollow interior; and wherein, in the second configuration, the check ball is spaced from the tapered valve seat to place the first communication line segment in fluid communication with the hollow interior.

2. The junction fitting of claim 1 further comprising:

a first longitudinal groove formed along said exterior surface, said first communication line segment being at least partially disposed within said first longitudinal groove; and a second longitudinal groove formed along said exterior surface, said second communication line segment being at least partially disposed within said second longitudinal groove.

3. The junction fitting of claim 2 wherein:

said main leg connector is a stinger connector; and said trunk connector is a receptacle connector.

4. The junction fitting of claim 3 wherein:

at least one of said first and third communication line segments is a hydraulic communication line segment; and said trunk connector has a socket and provides an uphole hydraulic communication line connection point at an axial location on the interior surface of said socket that is in fluid communication with said hydraulic communication line segment; and said main leg connector has a cylindrical probe and provides a downhole hydraulic communication line connection point at an axial location on the exterior surface of said probe that is in fluid communication with said hydraulic communication line segment.

5. The junction fitting of claim 1 further comprising:

a trunk connector located at said uphole end;

a main leg connector located at said downhole main end;

a lateral leg connector located at said downhole lateral end;

said trunk connector, said main leg connector, and said lateral leg connector each including an opening formed therethrough that is in fluid communication with said interior of said junction fitting;

said first communication line segment extending between said trunk connector and said main leg connector; and said second communication line segment extending between said trunk connector and said lateral leg connector.

6. The junction fitting of claim 5 further comprising:

a third communication line segment extending between said trunk connector and said main leg connector;

a fourth communication line segment extending between said trunk connector and said lateral leg connector;

said third communication line segment being at least partially disposed within said first longitudinal groove or a third longitudinal groove formed along said exterior surface; and said fourth communication line segment being at least partially disposed within said second longitudinal groove or a fourth longitudinal groove formed along said exterior surface.

7. The junction fitting of claim 6 further comprising:

first, second, third and fourth uphole communication line connection points defined by said trunk connector;

first and third downhole communication line connection points defined by said main leg connector;

second and fourth downhole communication line connection points defined by said lateral leg connector;

said first, second, third and fourth communication line segments extending between said first, second, third and fourth uphole and said first, second, third and fourth downhole communication line connection points, respectively;

said trunk connector arranged to connect said first, second, third and fourth communication line segments at said first, second, third and fourth uphole communication line connection points and to connect said interior of said junction fitting via said opening of trunk connector;

said main leg connector arranged to connect said first and third communication line segments at said first and third downhole communication line connection points and to connect said interior of said junction fitting via said opening of main leg connector; and said lateral leg connector arranged to connect said second and fourth communication line segments at said second and fourth downhole communication line connection points and to connect said interior of said junction fitting via said opening of lateral leg connector.

8. The junction fitting of claim 7 wherein:

said first and third downhole communication line connection points are located at differing first and second axial locations with respect to said main leg connector.

9. The junction fitting of claim 6 wherein:

each of first, second, third and fourth communication line segments is a type from the group consisting of a hydraulic communication line segment, an electric communication line segment, and a fiber optic communication line segment.

10. A method for completing a well, the method comprising:

positioning a main completion string in a main wellbore below a junction in the main wellbore, said main completion string defining an interior;

positioning a lateral completion string in a lateral wellbore extending from the junction, said lateral completion string defining an interior; then positioning a wye-shaped junction fitting to engage the main and lateral completion strings so as to i) establish fluid communication between an interior of said junction fitting and the interiors of said main and lateral completion strings, ii) establish communication between the surface of the well and the main completion string via a first communication line segment positioned outside the interior of the junction fitting, and iii) establish communication between the surface of the well and the lateral completion string via a second communication line segment positioned outside the interior of the junction fitting;

wherein establishing communication between the surface of the well and the main completion string via the first communication line segment comprises moving a valve assembly from a first configuration to a second configuration;

wherein the valve assembly comprises:

a port formed through the wall of the wye-shaped junction fitting to form a tapered valve seat adjacent the hollow interior and an opposing opening formed through the exterior surface;

a plug positioned within the opposing opening;

a check ball positioned within the port; and a spring positioned between the check ball and the plug, wherein the spring urges the check ball against the tapered valve seat;

wherein, in the first configuration, the check ball is seated in the tapered valve seat to fluidically isolate the first communication line segment from the hollow interior;

wherein, in the first configuration, at least a portion of the check ball protrudes into the hollow interior; and wherein, in the second configuration, the check ball is spaced from the tapered valve seat to place the first communication line segment in fluid communication with the hollow interior.

11. A well system for use within a well having a main wellbore and a lateral wellbore, comprising:

a junction fitting having a generally wye-shaped tubular body formed by a wall and defining a hollow interior, an exterior surface, an uphole end, and downhole main and lateral ends, said uphole end and downhole main and lateral ends being open to said interior, said junction fitting disposed at an intersection of said main wellbore and said lateral wellbore;

a tubing string disposed in said main wellbore uphole of said junction fitting and coupled to the uphole end of said junction fitting, said tubing string defining an interior that is fluidly coupled with said interior of said junction fitting;

a main completion string disposed in said main wellbore downhole of said junction fitting and coupled to the downhole main end of said junction fitting, said main completion string having an interior that is fluidly coupled with said interior of said junction fitting;

a lateral completion string disposed in said lateral wellbore and coupled to the downhole lateral end of said junction fitting, said lateral completion string having an interior that is fluidly coupled with said interior of said junction fitting;

a first communication line extending between said tubing string and said main completion string;

a second communication line extending between said tubing string and said lateral completion string;

said first and second communication lines being located completely outside of said interior of said junction fitting;

wherein a port is formed through the wall of the wye-shaped tubular body and defining a first opening facing towards the hollow interior and a second opening formed through the exterior surface;

wherein the wall forms a tapered valve seat around the first opening;

wherein the junction fitting further comprises a valve assembly that is movable between a first configuration and a second configuration, the valve assembly comprising:

a plug within the second opening;

a check ball within the port; and a spring between the check ball and the plug, wherein the spring urges the check ball against the tapered valve seat;

wherein, in the first configuration, the check ball is seated in the tapered valve seat to fluidically isolate the first communication line from the flow channel of the tubing string;

wherein, in the first configuration, at least a portion of the check ball protrudes into the hollow interior; and wherein, in the second configuration, the check ball is spaced from the tapered valve seat to place the first communication line in fluid communication with the flow channel of the tubing string.

12. The well system according to claim 11, further comprising:

a trunk connector pair disposed between said tubing string and said junction fitting, said trunk connector pair coupling said interior of said tubing string with said interior of said junction fitting, an upper portion of said first communication line with said mid portion of said first communication line, and an upper portion of said second communication line with said mid portion of said second communication line;

a main leg connector pair disposed between said main completion string and said junction fitting, said main leg connector pair coupling said interior of said main completion string with said interior of said junction fitting and a lower portion of said first communication line with said mid portion of said first communication line; and a lateral leg connector pair disposed between said lateral completion string and said junction fitting, said lateral leg connector pair coupling said interior of said lateral completion string with said interior of said junction fitting and a lower portion of said second communication line with said mid portion of said second communication line.

13. The well system of claim 12 further comprising:

a first longitudinal groove formed along said exterior surface of said junction fitting, a mid portion of said first communication line located within said first longitudinal groove; and a second longitudinal groove formed along said exterior surface of said junction fitting, a mid portion of said second communication line located within said second longitudinal groove.

14. The well system of claim 13 further comprising:

a third communication line extending between said tubing string and said main completion string;

a fourth communication line extending between said tubing string and said lateral completion string;

a mid portion of said third communication line located within said first longitudinal groove or a third longitudinal groove formed along said exterior surface of said junction fitting; and a mid portion of said fourth communication line located within said second longitudinal groove or a fourth longitudinal groove formed along said exterior surface of said junction fitting.

15. The well system of claim 14 further comprising:

first, second, third and fourth uphole communication line connection points defined by said trunk connector pair;

first and third downhole communication line connection points defined by said main leg connector pair;

second and fourth downhole communication line connection points defined by said lateral leg connector pair; and the mid portions of said first, second, third and fourth communication lines extending between said first, second, third and fourth uphole and said first, second, third and fourth downhole communication line connection points, respectively.

16. The well system of claim 15 wherein:

said first and third downhole communication line connection points are located at differing first and second axial locations with respect to said main leg connector pair.

17. The well system of claim 15 wherein:

said trunk connector pair includes a receptacle connector located at said uphole end of said junction fitting;

main leg connector includes a stinger connector located at said downhole main end of said junction fitting.

18. The well system of claim 17 wherein:

at least one of said first and third communication lines is a hydraulic communication line; and said receptacle connector of said trunk connector pair has a socket and provides a downhole hydraulic communication line connection point at an axial location on the interior surface of said socket that is in fluid communication with said hydraulic communication line; and said stinger connector of said downhole main connector pair has a cylindrical probe and provides an uphole hydraulic communication line connection point at an axial location on the exterior surface of said probe that is in fluid communication with said hydraulic communication line.

19. The well system of claim 18 further comprising:

first and second ports located at said downhole hydraulic communication line connection point and said uphole hydraulic communication line connection point, respectively;

first and second valves disposed within said first and second ports, respectively.

20. The well system of claim 17 wherein:

at least one of said first and third communication lines is an electrical communication line; and said receptacle connector of said trunk connector pair has a socket and provides a downhole electrical communication line connection point at an axial location on the interior surface of said socket that is electrically coupled with said electrical communication line; and said stinger connector of said downhole main connector pair has a cylindrical probe and provides an uphole electrical communication line connection point at an axial location on the exterior surface of said probe that is electrically coupled with said electrical communication line.

21. The well system of claim 20 further comprising:

first and second electrical slip rings located at said downhole electrical communication line connection point and said uphole electrical communication line connection point, respectively.

22. The well system of claim 17 wherein:

at least one of said first and third communication lines is an optical communication line; and said receptacle connector of said trunk connector pair has a socket and provides a downhole optical communication line connection point at an axial location on the interior surface of said socket that is optically coupled with said optical communication line; and said stinger connector of said downhole main connector pair has a cylindrical probe and provides an uphole optical communication line connection point at an axial location on the exterior surface of said probe that is optically coupled with said optical communication line.

23. The well system of claim 22 further comprising:

first and second optical slip rings located at said downhole optical communication line connection point and said uphole optical communication line connection point, respectively.

24. The well system of claim 14 wherein:

each of first, second, third and fourth communication lines is a type from the group consisting of a hydraulic communication line, an electric communication line, and a fiber optic communication line.

* * * * *